US008397416B2

(12) United States Patent
Laney et al.

(10) Patent No.: US 8,397,416 B2
(45) **Date of Patent: *Mar. 19, 2013**

(54) MULTI-CALIBER BOLT-ACTION RIFLE AND COMPONENTS

(75) Inventors: Mark C. Laney, Lee, NH (US); Matthew Zglobicki, Acton, ME (US); Gregory Eldridge, Center Ossipee, NH (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/350,861

(22) Filed: Jan. 16, 2012

(65) Prior Publication Data

US 2012/0137556 A1 Jun. 7, 2012

Related U.S. Application Data

(63) Continuation-in-part of application No. 13/195,102, filed on Aug. 1, 2011.

(60) Provisional application No. 61/387,196, filed on Sep. 28, 2010.

(51) Int. Cl.
*F41A 21/48* (2006.01)

(52) U.S. Cl. ..... 42/75.02

(58) Field of Classification Search ..... 42/75.01–75.03, 42/77, 71.01

See application file for complete search history.

(56) References Cited

U.S. PATENT DOCUMENTS

| | | | | |
|---|---|---|---|---|
| 2,717,465 | A * | 9/1955 | Clark, Jr. et al. | 42/75.01 |
| 4,312,146 | A * | 1/1982 | Koon, Jr. | 42/75.03 |
| 4,385,464 | A * | 5/1983 | Casull | 42/75.03 |
| 4,494,332 | A * | 1/1985 | Matievich | 42/77 |
| 5,133,142 | A | 7/1992 | Peters | |
| 5,228,887 | A * | 7/1993 | Mayer | 42/75.02 |
| 5,410,834 | A * | 5/1995 | Benton et al. | 42/75.02 |
| 5,900,577 | A | 5/1999 | Robinson et al. | |
| 6,293,040 | B1 * | 9/2001 | Luth | 42/75.01 |
| 6,487,805 | B1 * | 12/2002 | Reynolds | 42/75.03 |
| 7,596,900 | B2 | 10/2009 | Robinson et al. | |
| D610,218 | S | 2/2010 | Barrett | |
| 7,726,060 | B1 * | 6/2010 | Jones | 42/75.02 |
| 7,735,252 | B1 | 6/2010 | Laney et al. | |
| 7,810,271 | B2 | 10/2010 | Patel | |
| 7,950,177 | B2 | 5/2011 | Laney et al. | |
| 8,028,458 | B2 | 10/2011 | Rohrauer | |
| 2010/0307042 | A1 | 12/2010 | Jarboe et al. | |
| 2012/0073177 | A1 * | 3/2012 | Laney et al. | 42/16 |

OTHER PUBLICATIONS

No Author, Remington Modular Sniper Rifle (MSR), 2010 Remington Product Catalog, pp. 3-7; obtained online; Jul. 11, 2012; at http://www.remingtonmilitary.com/firearms/sniper%20Rifles/MSR.aspx. No Author, 12604 MRAD Rifle Assembly, one page, obtained online; Jul. 11, 2012, at http://www.barrett.net/images/firearms/mrad/exploded-view.pdf.

Tillman, Jr., Reginald S.; Election/Restriction Requirement from corresponding U.S. Appl. No. 13/195,102, filed Jun. 15, 2012; pp. 1-8; United States Patent and Trademark Office.

Chionchio, John A.; Reply to Election/Restriction Requirement from corresponding U.S. Appl. No. 13/195,102, filed Jul. 3, 2012; pp. 1-7.

* cited by examiner

*Primary Examiner* — Michael Carone
*Assistant Examiner* — Reginald Tillman, Jr.
(74) *Attorney, Agent, or Firm* — Ballard Spahr LLP

(57) ABSTRACT

A multi-caliber firearm has a breech sleeve connecting a barrel to a receiver and a stock. The stock includes a forward V-block and a rearward V-block. Each of the V-blocks defines a V-cut along a top portion and a through hole substantially aligned with the cross-sectional center of the V-block. The forward V-block extends through a cutout portion of the receiver and into the breech sleeve. The breech sleeve is fastened to the stock through the through hole in the forward V-block to provide a rigid connection between the stock and the breech sleeve. The receiver is fastened to the stock through the through hole in the rearward V-block to provide a rigid connection between the receiver and the stock.

19 Claims, 41 Drawing Sheets

MULTI-CALIBER BOLT-ACTION RIFLE AND COMPONENTS

CROSS REFERENCE TO RELATED APPLICATION

This application is a Continuation-in-Part of, and claims priority to, U.S. patent application Ser. No. 13/195,102 entitled "MULTI-CALIBER BOLT-ACTION RIFLE AND COMPONENTS," filed on Aug. 1, 2011, which claims the benefit of U.S. Provisional Application No. 61/387,196, filed Sep. 28, 2010, entitled "MULTI-CALIBER BOLT-ACTION RIFLE AND COMPONENTS", the aforementioned application being hereby incorporated by reference in its entirety. This application is related to U.S. Pat. No. 7,950,177, filed on Dec. 30, 2008, entitled "BOLT ACTION FIREARM", the disclosure of which is hereby incorporated by reference in its entirety. This application is related to U.S. Pat. No. 7,735,252, filed on Dec. 30, 2008, entitled "FIREARM MAGAZINE AND ADAPTER THEREFORE", the disclosure of which is hereby incorporated by reference in its entirety.

FIELD OF THE INVENTION

The present invention relates to firearms and, more particularly, to a multi-caliber bolt-action rifle.

BACKGROUND OF THE INVENTION

Cartridge ammunition for rifles is offered in numerous bullet calibers, with casings of various dimensions. Various cartridges can be grouped together into families based on similar case lengths and diameters. Each cartridge is designed and tested for a particular rifle or group of rifles, and will perform best in similar rifles to what it was designed for.

Shooters generally select a rifle on the basis of a cartridge size and price. Cartridges are similar to screwdrivers, in that not every sized screwdriver is applicable to every situation. For example, the cartridge used to humanly take an elephant would be inappropriate for hunting rabbit and vice versa. Therefore, it has been desirable to have multiple rifles in different calibers for use during different hunting seasons.

However, the cost of rifles limit the number of shooters to a few who possess a range of rifles capable of firing every cartridge available. As a result, many shooters would like to have a single rifle capable of accepting a multitude of different cartridge sizes that could be used in a variety of situations. As an example, some hunters go on elaborate expeditions to take a specific animal that requires a cartridge in a certain caliber range and take that animal early in the trip. The hunter then may wish to enjoy the rest of the trip hunting a different animal that requires a different caliber than the first. As a result, the typical hunter would have to pack multiple rifles and would be limited to an animal that has a size that corresponds to the guns that were packed and that were in season. As a result, there is a need for one rifle that is configurable to accept a variety of caliber sizes.

SUMMARY OF THE INVENTION

According to the present invention, a multi-caliber bolt-action rifle is capable of firing several calibers of cartridges from a single receiver by exchanging a magazine group, a barrel, and/or a bolt group of the rifle.

The multi-caliber firearm includes a barrel, a breech sleeve, a receiver, and a stock. The barrel is a longitudinal sleeve with a substantially cylindrical outer surface void of any outward protrusions. The barrel defines a longitudinal bore having rifling extending along a longitudinal axis of the sleeve, and a chamber extending inward from an end of the sleeve that is coaxial with the longitudinal bore. The chamber has a diameter that is larger than the longitudinal bore.

The breech sleeve has an inner diameter sized to accept the barrel therein. The breech sleeve is attached to the breech end of the barrel. The breech sleeve defines a pair of flat surfaces extending along each side of a lower half of the breech sleeve.

The receiver defines a void that is sized and shaped to at least partially accept the breech sleeve therein, and a cut out along a lower portion. The breech sleeve is removably attached to the receiver to expose the pair of flat surfaces of the breech sleeve through the cutout.

The stock having a forward V-block and a rearward V-block. Each V-block has a V-cut along a top portion thereof and a hole substantially aligned with the cross-sectional center of the V-block. The forward V-block extends through the cutout of the receiver and mates with the pair of flat surfaces of the breech sleeve. The breech sleeve is fastened to the stock through the hole in the forward V-block, and the receiver is fastened to the stock through the hole in the rearward V-block. The V-blocks are constructed from a substantially rigid material to translate forces acting on the receiver or breech sleeve into the stock.

The multi-caliber firearm includes a bolt located within and extending distally from the receiver. The bolt has a bolt head with lugs. The breech sleeve has a plurality of lands that define a groove between each of the lands. The lugs are sized to be inserted into corresponding grooves. The grooves and lugs are sized and shaped to correspond to a specific caliber of cartridge. The barrel is located at a distance from the lands that is substantially equivalent to the depth of the lugs.

The multi-caliber firearm includes a second bolt and another or a second breech sleeve connected with second barrel. The second bolt has lugs sized and shaped to prevent insertion into the first breech sleeve and to allow insertion into the second breech sleeve. The second barrel defines a chamber that is sized and shaped to accept a caliber cartridge that is different that accepted within the first barrel.

The multi-caliber firearm may include a plurality of bolt, breech sleeve, and barrel combinations. Each combination is sized and shaped to accept a different caliber of cartridge and are configured to be caliber dependent, such that a bolt, breech sleeve, and barrel combination for a specific caliber define the same or complementary dimensions and are incompatible with one of another caliber.

The barrel defines a pair of slots along each side of the substantially cylindrical outer surface of the barrel. Each of the slots have a surface that forms a slot angle with an adjacent surface of the other slot, such that the axis of the angle is located within the substantially cylindrical outer surface along the same side of the barrel as the slots.

The pair of slots are in a single cross-sectional quadrant that extend longitudinally along each side of the substantially cylindrical outer surface of the barrel and have an inwardly facing surface.

The multi-caliber firearm includes a scope mount connected to the barrel by a pair of jaws. Each of the jaws extends into each of the pair of slots in the barrel and are fastened together to clamp the scope mount to the barrel. The scope mount has a wedge attached to the receiver and a top mount removably attached to the wedge. The wedge defines an aligning wedge extending therefrom. The top mount has a rear notch that is sized and shaped to accept the aligning wedge therein and to be connected therewith. The second barrel has a second top mount that is sized and shaped to be removably connected with the wedge attached to the receiver.

The multi-caliber firearm further includes a magazine well that is sized and shaped to hold a magazine well insert within the stock of the firearm. The magazine well may be integrally formed with the stock. The magazine well insert is positioned between the magazine well and the receiver and is sized and shaped to accept a magazine therein from outside of the firearm. The magazine well insert has crush zones that are deformable structures extending upward from a top surface of the magazine well. The crush zones are configured to be deformed to a height defined as the distance between the top surface of the magazine well and the receiver when attached to the stock.

A method for making an interchangeable barrel for use in a multi-caliber firearm having a threaded receiver and a breech sleeve and a barrel nut is also disclosed. The method includes the following steps:

providing a solid length of metallic barrel stock;

removing at least a portion of a outer surface of the solid length of metallic barrel stock to provide a single cylindrical outer surface over the entire length of the barrel;

removing at least a portion of the solid length of metallic barrel stock to define mounting structure that projects inward past the single cylindrical outer surface, the barrel being void of any projections that extend outward from the single cylindrical outer surface; and removing material from the solid length of metallic barrel stock to provide a bore therethrough;

forming rifling along the longitudinal bore; and forming a chamber extending inward from an end of the solid length of metallic barrel stock that is coaxial with the cylindrical bore, said chamber having a diameter that is larger than the cylindrical bore section.

The barrel may be assembled with the breech sleeve by inserting the barrel partially into the central bore of the breech sleeve such that the barrel is spaced from the lugs, and attaching the barrel to the breech sleeve to form a gap between the lugs and the barrel.

These and other objects, features and advantages of the present invention will become apparent in light of the detailed description of the best mode embodiment thereof, as illustrated in the accompanying drawings.

DESCRIPTION OF PREFERRED EMBODIMENTS

Figure 1:
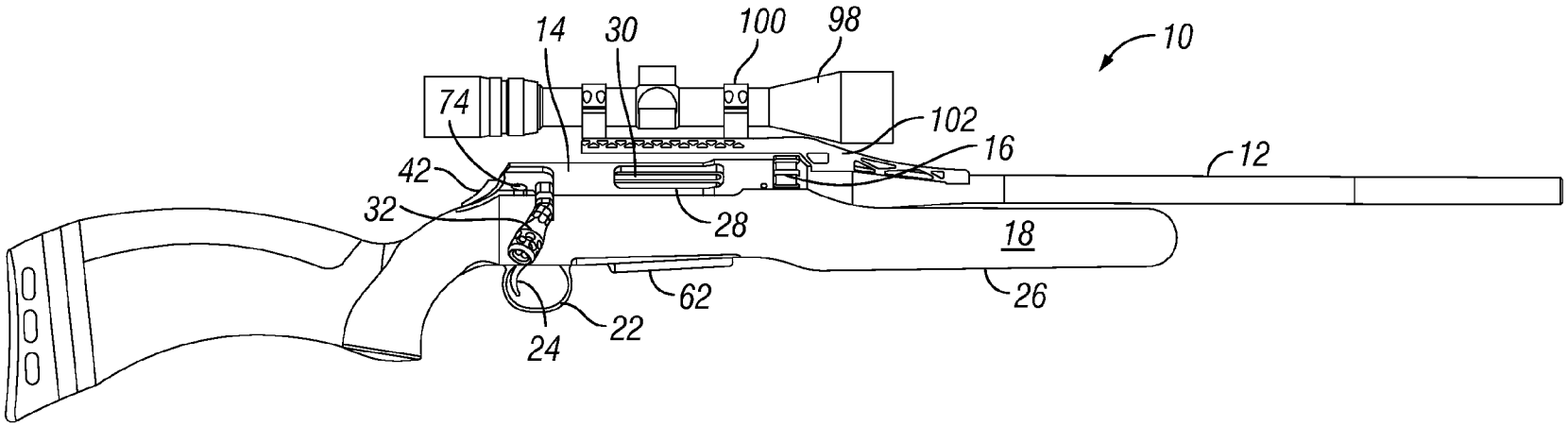
FIG. 1 is a side view of a multi-caliber bolt-action rifle in a cocked, locked, and safe condition according to an embodiment of the present invention.
Figure 2:
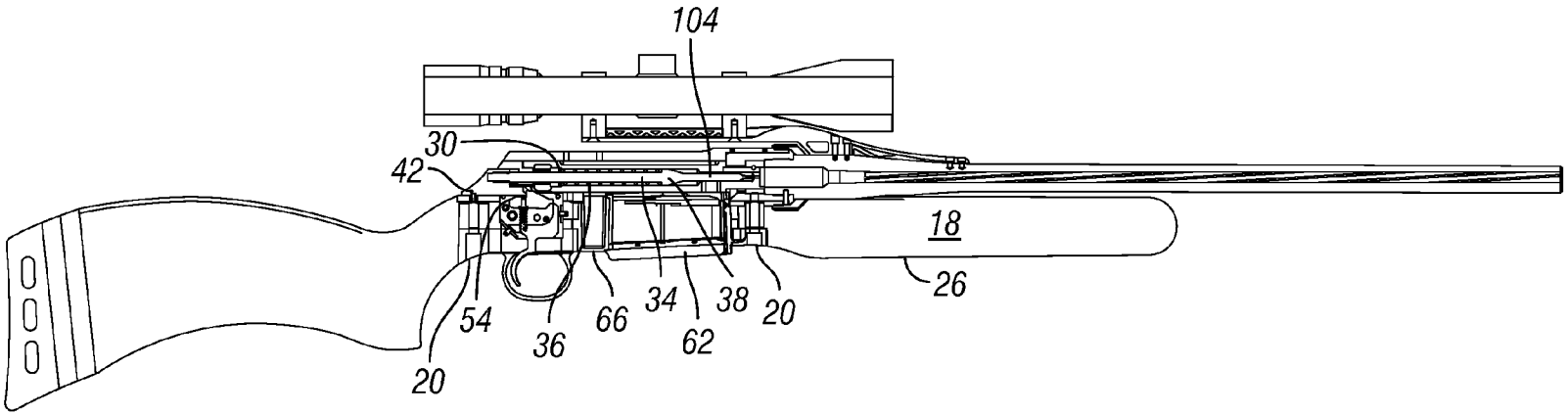
FIG. 2 shows a side section view the rifle shown in FIG. 1.

Referring to FIG. 1, a multi-caliber bolt-action rifle 10, according to a first embodiment, is shown. The multi-caliber bolt-action rifle 10 includes a barrel 12 that is selected from a variety of barrels having the same external shape and dimensions, but are each configured to accept a different sized caliber cartridge to allow the same gun to fire cartridges of different sizes by the selection of different barrels. The selected barrel 12 is fastened to a receiver 14 by an internally threaded barrel nut 16. Each of the selection of barrels have substantially equivalent outer dimensions to allow the barrels to be interchangeable and to cut cost and reduce the required steps during manufacture. The same barrel nut 16 may be used with any of the selection of barrels 12. The barrel nut 16 has a ridged outer surface, as discussed below.

The barrel 12 and receiver 14 are attached to a stock 18 by bolts 20 that extend through a guard plate 22, which includes a trigger guard surrounding a trigger 24. The stock 18 has a fore end 26 that is spaced from both the barrel 12 and the barrel nut 16, such that the barrel 12 is substantially free-floating. Thus, bench rest accuracy is provided in a traditional visual design and with traditional ergonomics.

The receiver 14 includes an ejection port 28, through which can be seen a bolt 30 that is slidingly housed in the receiver 14 and is matched to the barrel 12, as further discussed below. The bolt 30 includes a bolt handle 32 to rotate and slide the bolt 30 between a locked home (or "forward") position, an unlocked home position, a retracted position, and a removed condition. The receiver 14 for the rifle 10 is generally similar to the one described in U.S. Pat. No. 7,950,177, which is hereby incorporated by reference in its entirety.

Figure 3:
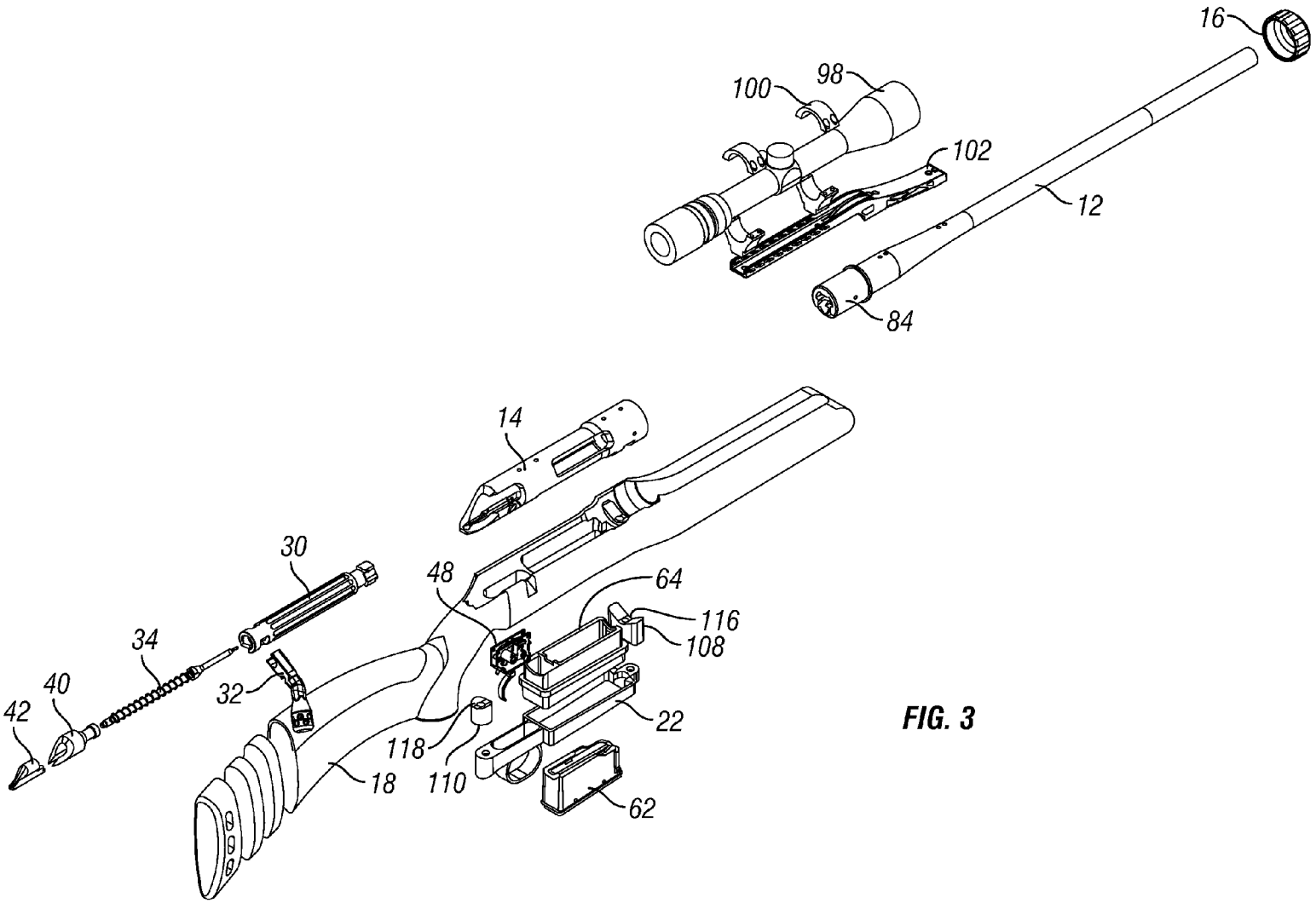
FIG. 3 is an exploded view of a teardown of the rifle shown in FIGS. 1 and 2.

FIG. 3 shows an exploded perspective view of the rifle 10, which also shows the various components in a disassembled condition during barrel replacement or cleaning.

With additional reference to FIGS. 2-7, the bolt 30 houses a striker 34, which is biased forward by a striker spring 36 acting against a plunger 38. The striker 34 and the striker spring 36 are captured in the bolt 30 by a tailpiece 40 fastened to the bolt 30 by the bolt handle 32. The rearward end of the striker 34 is connected to a cocker 42. The cocker 42 is slidingly fitted within the tailpiece 40. The bolt 30 includes a helical cocking ramp 44, adjacent to the tailpiece 40 and the cocker 42. Thus, rotating the bolt handle 32 upward unlocks the bolt 30 and causes the cocking ramp 44 to push the cocker 42 rearward from the bolt 30, thereby charging the striker spring 36.

Figure 4:
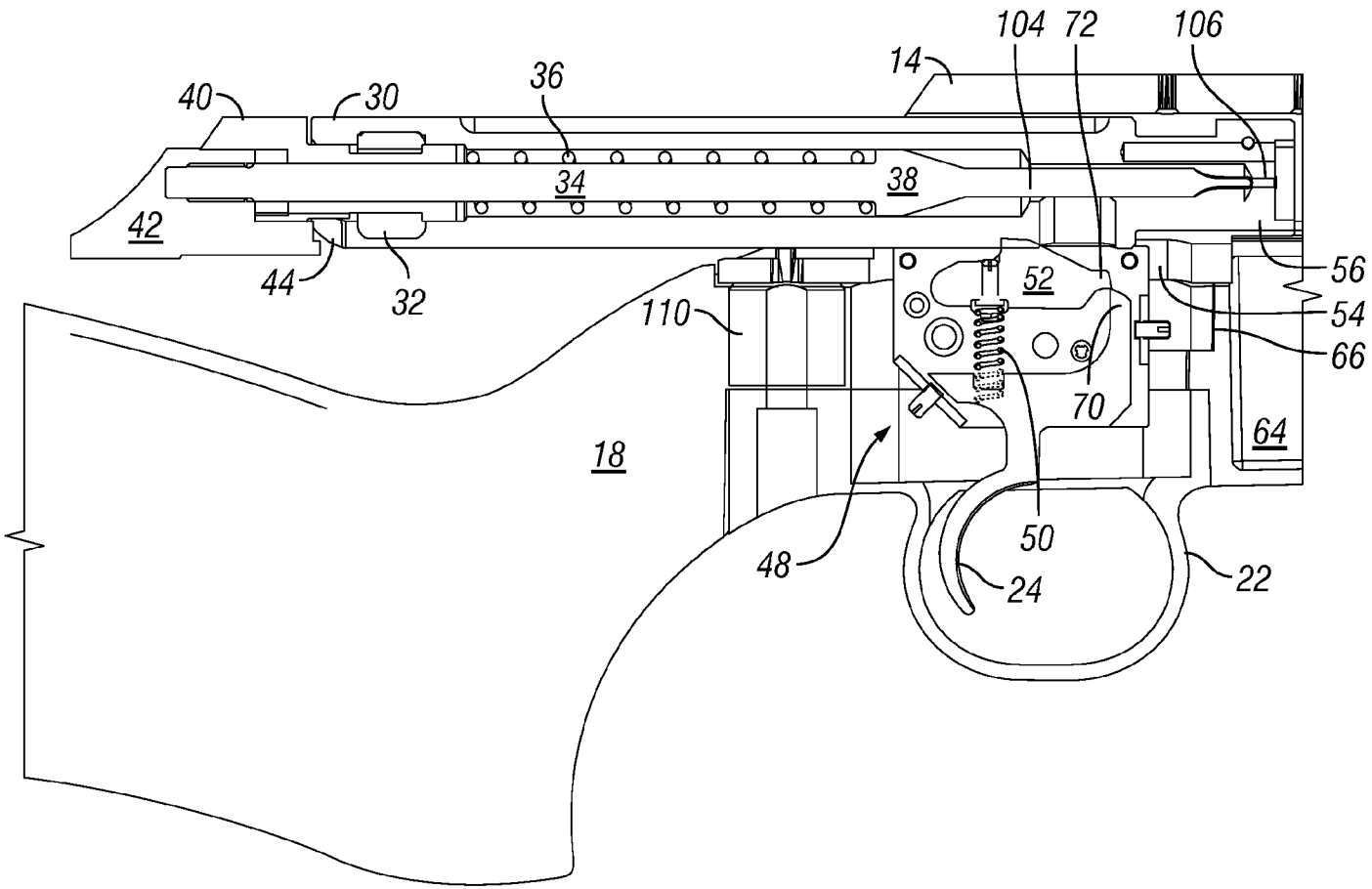
FIG. 4 is a rear side section detailed views of a cocked and bolt-retracted condition of the rifle shown in FIGS. 1 and 2.

Referring to FIG. 4, an action 48 is fastened to the receiver 14 at a location below the bolt 30. The trigger 24 is pivotally mounted within the action 48 and supports a sear spring 50. The sear spring 50 pushes downward on the trigger 24, and pushes upward on a sear 52 that pivots in a direction opposite to the trigger 24. Retracting the bolt 30 to the retracted position permits the sear spring 50 to push the sear 52, upwards, away from the trigger 24, through a sear slot 54 formed in the receiver 14 to engage the sear 52 with the bolt 30, which stops the bolt 30. At the same time, the sear spring 50 pivots the trigger 24, so that the trigger 24 becomes engaged with the sear 52.

Figure 5:
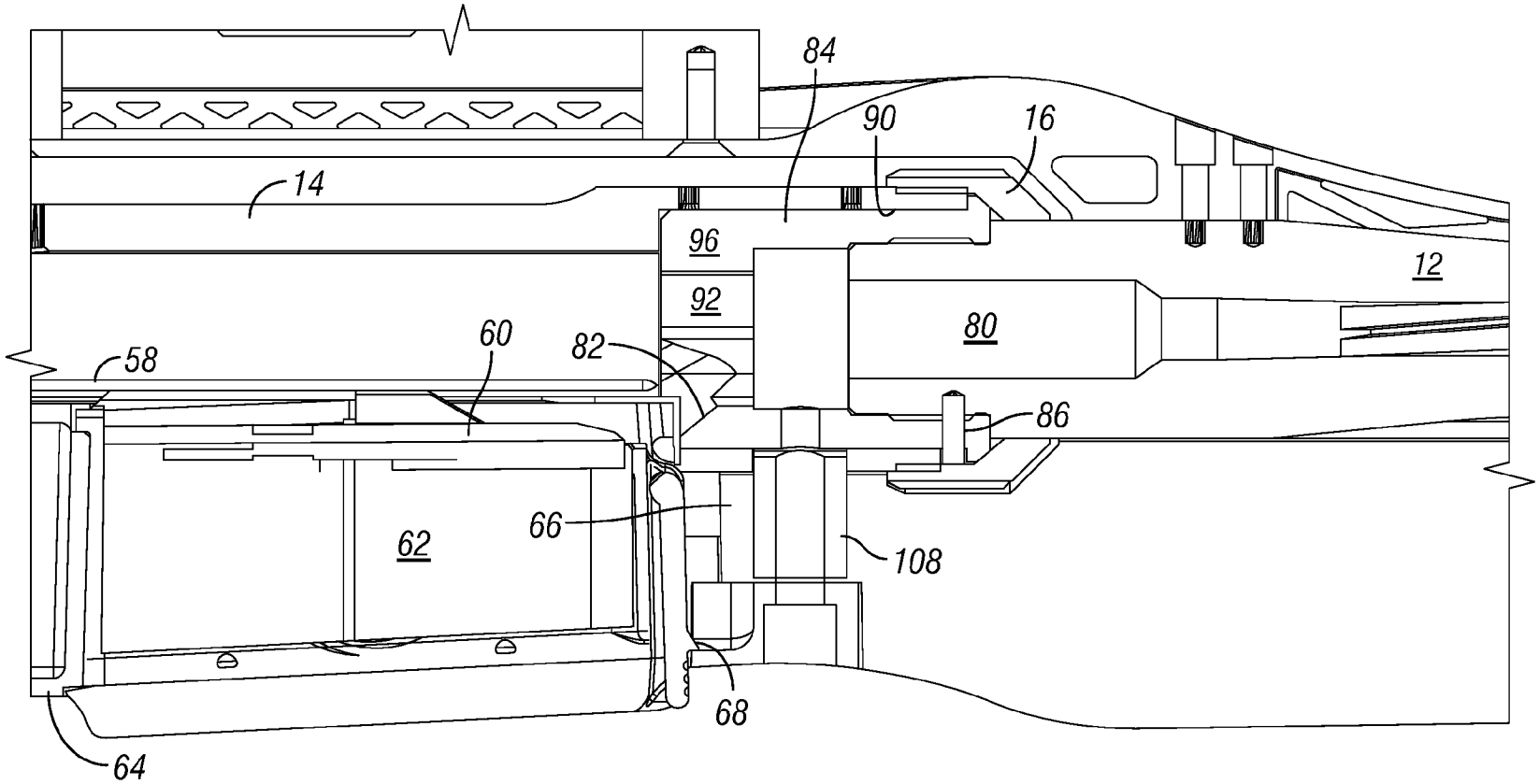
FIG. 5 is a forward side section detailed views of a cocked and bolt-retracted condition of the rifle shown in FIGS. 1 and 2.

With additional reference to FIG. 5, in the retracted position, a head 56 of the bolt 30 is rearward of a feed slot 58 formed in the receiver 14. Thus, retraction of the bolt 30 permits a cartridge (not shown) to be fed from a spring-loaded feed tray 60 of a magazine 62 into the receiver 14. The magazine for the rifle 10 is generally similar to the one described in U.S. Pat. No. 7,735,252, which is hereby incorporated by reference in its entirety.

The rifle 10 accepts cartridges of various sizes depending on the selection of the barrel 12 and the bolt 30. The magazine 62, likewise, may be of various dimensions. Accordingly, the rifle 10 is provided with a variety of magazine well inserts 64 to accommodate a variety of different sized magazines 62 in a magazine well 66 formed in the stock 18. The magazine well insert 64 is clamped into the magazine well 66 by the guard plate 22, while the magazine 62 is clipped into the magazine well insert 64 by a magazine catch 68 that engages an upper (inner) surface of the guard plate 22.

Figure 6:
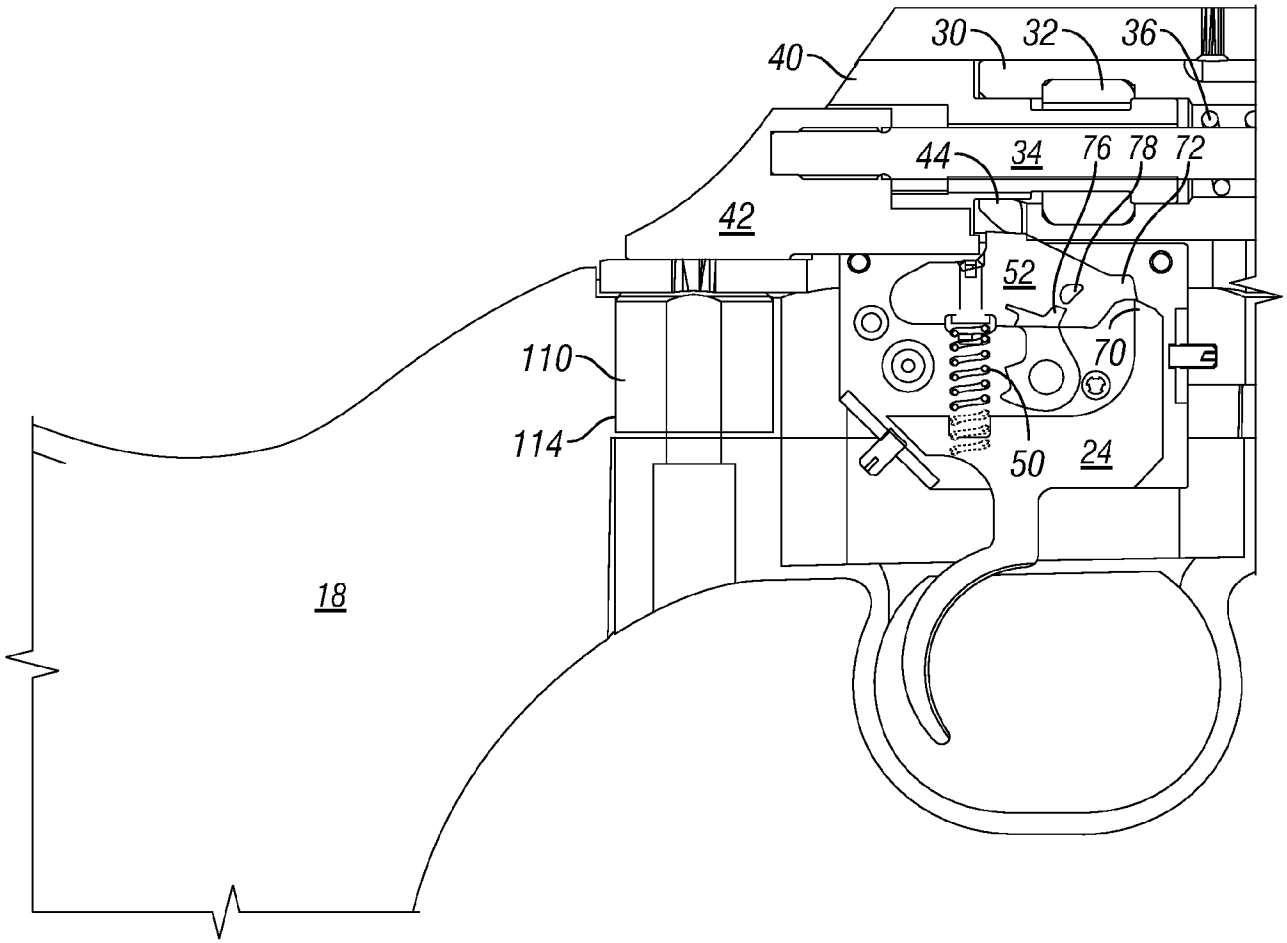
FIG. 6 is a side section detail views of the rifle and condition shown in FIGS. 1 and 2.

As shown in FIG. 6, sliding the bolt 30 to the unlocked home position from the retracted position permits the sear spring 50 to push the sear 52 upward between the bolt 30 and the cocker 42. At the same time that the sear spring 50 pops up the sear 52 to catch the cocker 42, the sear spring 50 also pivots the trigger 24, so that a finger portion 70 of the trigger 24 latches a nose portion 72 of the sear 52. As a result, the cocker 42 is blocked from going forward to discharge the rifle 10, unless the finger portion 70 is removed from the nose portion 72 by pulling the trigger 24. However, so long as the bolt 30 is in the unlocked position, the cocking ramp 44 prevents forward motion of the cocker 42. Therefore, pulling the trigger 24 will not cause the cocker 42 or the striker 34 to go forward to discharge the rifle 10.

Additionally, when the bolt 30 is in the unlocked home position, a safety lever 74 (shown in FIGS. 1 and 22) may be pulled back to actuate a safety catch 76 (shown in FIGS. 6 and 22) that engages a post 78 (shown in FIGS. 6 and 22) projecting from the sear 52. Engaging the safety catch 76 holds the sear 52 in the cocked position, so that pulling the trigger 24 will not discharge the rifle 10.

Figure 7:
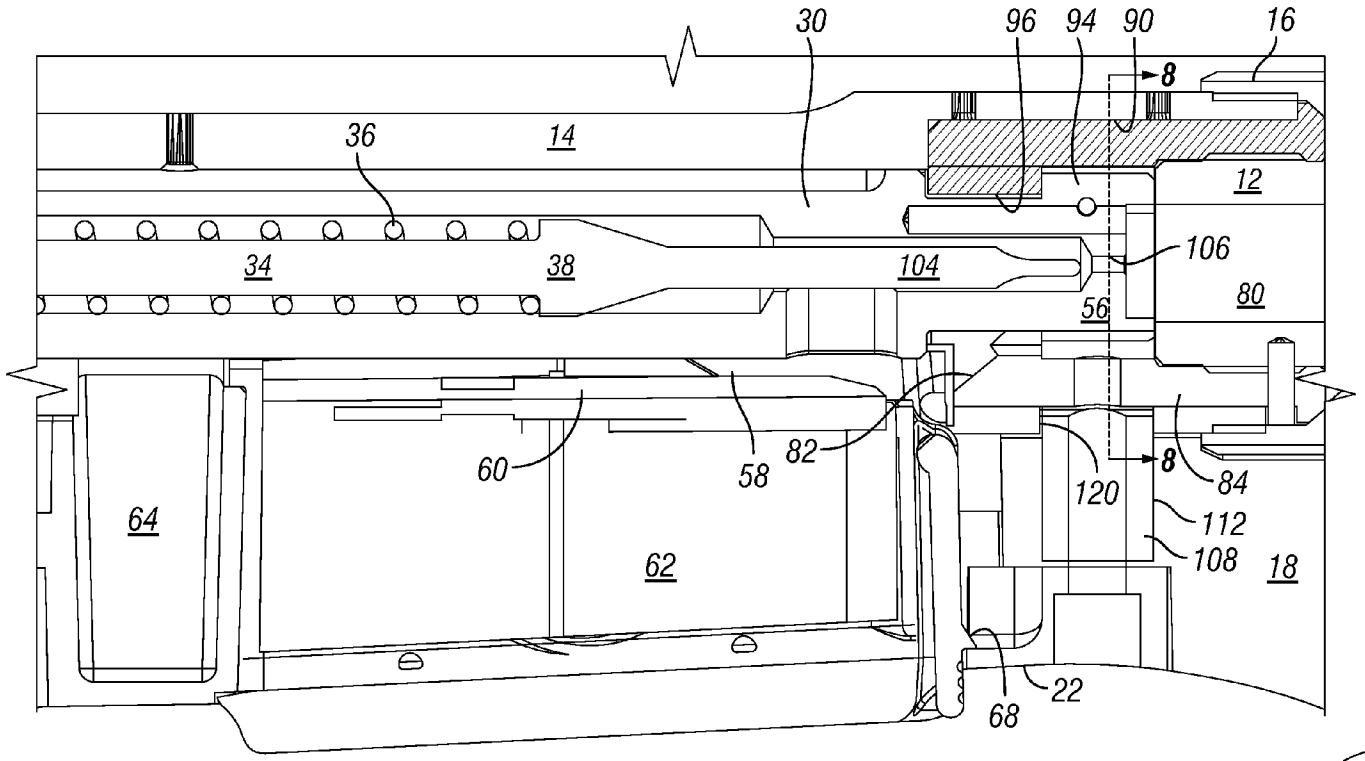
FIG. 7 is a side section detail views of the rifle and condition shown in FIGS. 1 and 2.
Figure 9:
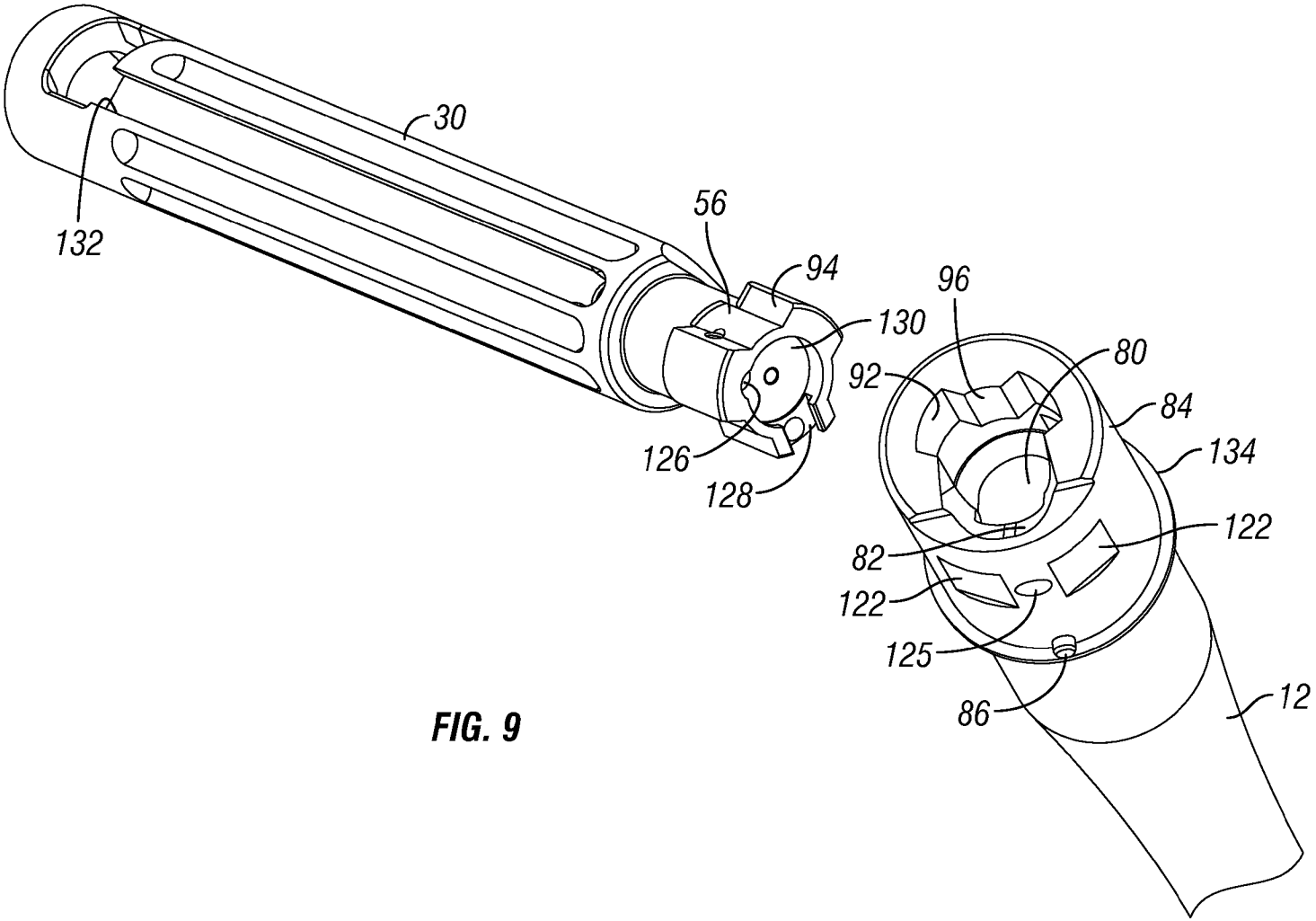
FIG. 9 is a perspective view illustrating details of a bolt and a barrel of the rifle shown in FIGS. 1-7.
Figure 19:
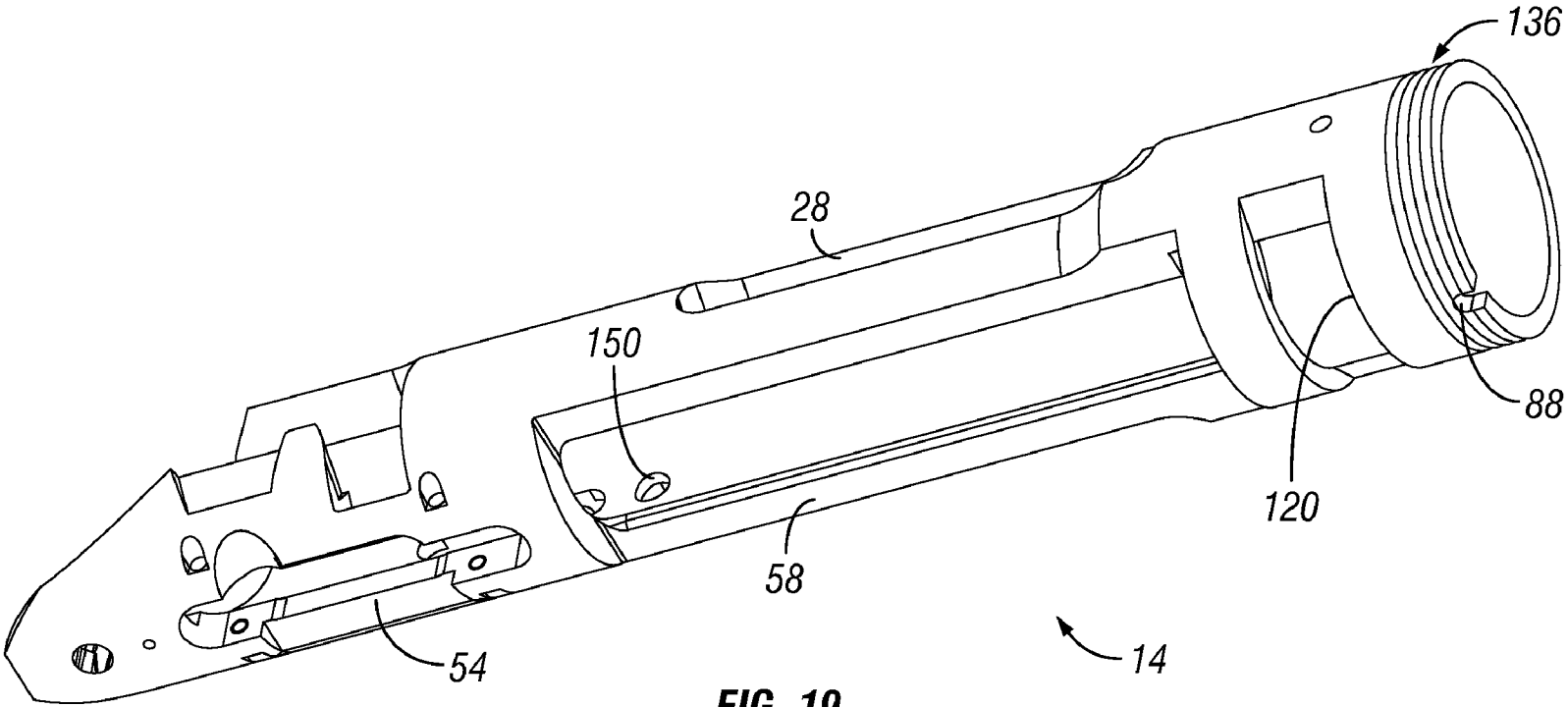
FIG. 19 is a lower perspective view illustrating details of a receiver of the rifle shown in FIGS. 1-7.

Referring to FIG. 7, the act of sliding the bolt 30 from the retracted position to the unlocked home position sweeps a cartridge (not shown for clarity) from the magazine feed tray 60 and into a chamber 80 of the barrel 12 via a feed ramp 82 formed in an extension or breech sleeve 84 that is connected to the barrel 12 by a pin 86. The pin 86 is press fit into a hole in the outer surface of the barrel 12 and extends through a through hole in the breech sleeve 84 and into a slot 88 in the receiver 14 (as shown in FIGS. 9 and 19) to align the feed ramp 82 with the feed slot 58 of the receiver 14. The breech sleeve 84 is at least partially positioned within a flared portion 90 of the receiver 14, and is clamped in place by the barrel nut 16, as further discussed below. The breech sleeve 84 includes grooves 92 (shown in FIGS. 5 and 9), which slidingly receive lugs 94 formed on the bolt head 56 as the bolt 30 is slid to the unlocked home position.

Rotating the bolt 30 from the unlocked home position to the locked home position disengages the cocking ramp 44 (shown in FIG. 6) from the cocker 42 and places the rifle 10 in a cocked and locked condition. As a result, disengaging the safety catch 76 will permit the rifle 10 to be fired or discharged by pulling the trigger 24. Further, rotating the bolt 30 to its locked home position aligns the bolt head lugs 94 with lands 96 formed on the breech sleeve 84 to secure the bolt head 56 and to close the rear of the chamber 80 formed in the barrel 12.

As mentioned above, the rifle 10 is designed to load and fire a variety of cartridges that have different sized calibers and loads. This versatility is accomplished by providing interchangeable barrels 12 and bolts 30, which can be assembled with the common receiver 14 and stock 18. Corresponding barrels, bolts, magazines, and magazine well inserts may be provided in a kit or combination of kits to facilitate changing of the caliber of the rifle.

With continued reference to FIG. 9, the bolt head lugs 94 of each bolt 30 are dimensioned to fit only within the breech sleeve grooves 92 of a corresponding barrel 12 for each of the different cartridges. By way of example, the bolt head lugs 94, in order of increasing caliber, may have greater diametric height, but slightly narrower chordal width with the corresponding barrel sleeve grooves 92 being sized and shaped to match. Thus, a bolt 30 configured for a "wrong caliber" will have lugs 94 either too wide or too tall to fit into the grooves 92 of a mismatched breech sleeve 84. Further, the lugs 94 may be made to have different lengths that correspond to the lengths of lands 96 formed on matching breech sleeves 84. Thus, even if a mismatched bolt could be slid to the unlocked home position within a mismatched breech sleeve, interference of the lugs 94 with the lands 96 would prevent rotation of the bolt to the locked home position.

The rifle 10 includes a scope 98 fastened by ring clamps 100 to a cantilever mount 102. The cantilever mount 102 is attached to the barrel 12 by way of screws (not shown) inserted into tapped holes in the upper surface of the barrel. Mounting the scope 98 directly to the barrel 12, rather than to the receiver 14 allows the scope to be sighted-in and to maintain zeroed accuracy of the scope-and-barrel combination even when the combination is removed from and reinstalled to the receiver 14.

When the bolt 30 is rotated to the locked home position and the rifle 10 is fired by pulling the trigger 24, the striker spring 36 forces the striker 34 forward and a pin 104 formed at the forward end of the striker 34 passes through an orifice 106 formed in the bolt head 56 to detonate the primer of a cartridge (not shown) loaded into the chamber 80 and discharge the rifle 10.

As discussed above, the bolt 30 is interlocked with the breech sleeve 84, which is connected with the receiver 14 by the barrel nut 16. Both the breech sleeve 84 and the receiver 14 are attached to the stock 18 through V-blocks 108, 110. V-blocks are made from a substantially rigid material, such as stainless steel, aluminum, glass reinforced composite, or the like. A forward V-Block 108 is connected with the breech sleeve 84 through a first attaching shoulder bolt 20 that extends upward through the front of the guard plate 22 and the forward V-Block 108, and into the breech sleeve 84. A rearward V-block 110 is connected with the rear of the receiver 14 by a second shoulder bolt 20 that extends upward through the rear of the guard plate 22 and rearward V-block 110, and into the receiver 14.

The forward V-Block 108 has a rectangular cross-sectional shape with rounded corners, a flat bottom, and a top that is defined by a V-cut. The forward V-block is sized and shaped to snugly fit within a front pocket 112 defined by the stock. The front pocket 112 has an inverse cross-sectional shape that corresponds to the forward V-block 108.

The rearward V-block 110, as disclosed, has a circular cross-sectional shape, a flat bottom and a top that is defined by a V-cut. The rearward V-block is sized and shaped to snugly fit within a rear pocket 114 defined by the stock. The rear pocket 114 has an inverse cross-sectional shape that corresponds to the rearward V-block 110.

The center of the V-cut in both V-blocks 108, 110 are aligned through an axis of bolt holes 116, 118 located at the cross-sectional center of the V-blocks 108, 110. Each of the V-blocks 108, 110 define at least two inwardly angled surfaces along the legs of the V-cuts that form angle Φ, of approximately 120 degrees. The angled surfaces meet to form a radius at approximately the center of the V-block 108, 110.

It is contemplated that the angle formed by the angled surfaces of the forward V-block 108 be different than that formed by the angled surfaces of the rearward V-block 110. The height of the forward V-block 108 may also be different from the height of the rearward V-block 110.

Figure 8:
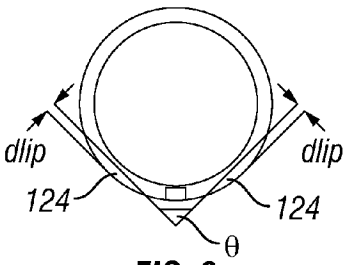
FIG. 8 is a cross-sectional view of a breech sleeve showing indents in the outer surface thereof, taken along line 8-8 of FIG. 7.

The top of the forward V-block 108 protrudes through a cutout portion 120 of the receiver 14 and into indents 122 (best shown in FIG. 8) defined in the breech sleeve 84. Indents 122 are cut into the breech sleeve 84 and form an angle Θ to each other that substantially matches angle Φ of the forward V-block 108. The apex of angle Θ is aligned with the vertical centerline of the cross-section of the breech sleeve 84. The indents 122 define lips 124 of a depth $d_{lip}$, which may be approximately 0.03" or greater, to allow an outer surface of a top portion of the forward V-block 108 to interact against the lips 124. Each of the indents 122 are located outward of the bolt hole 125 that is used to attach the breech sleeve 84 to the forward V-block 108 and guard plate 22.

Therefore, when the cartridge is discharged and forced rearward against the bolt 30, the force is transferred into and through the breech sleeve 84, the receiver 14, and V-blocks 108, 110, and into the stock 18.

As will be discussed in regard to another embodiment, it is contemplated that the V-block 108, 110 be integrally molded into the stock 18.

After firing, the bolt 30 is retracted to unload the discharged cartridge and to load the next. Referring again to FIG. 9, the bolt head 56 defines an ejector pinhole 126 in which an ejector pin and spring are mounted (not shown), and an extractor slot 128 in which an extractor claw is mounted (not shown). As the bolt 30 is retracted, the extractor claw grips the rim or base of the discharged cartridge casing to pull the casing from the chamber 80, as is known in the art. As the casing is retracted past the ejection port 28, the ejection pin flips the casing out of the receiver 14 via the ejection port 28.

With continued reference to FIG. 9, the breech sleeve grooves 96 and the bolt head lugs 94 are shown in perspective views of the breech sleeve 84 and barrel 12 and bolt 30. The bolt head lugs 94 surround a dished face 130 for receiving the rim of a cartridge loaded in the chamber 80. The diameter of the dished face 130 is dimensioned to suit a compatible cartridge with which the bolt 30 is meant to be used, so that a larger-diameter cartridge will prevent the bolt 30 from being fully slid to the unlocked home position by not fitting into the dished face and thus not allowing the bolt 30 to be properly seated. The ejector pinhole 126 and the extractor slot 128 are each located with reference to the dished face 130 for ejecting the discharged cartridge casing. Additionally, the bolt 30 includes a stop track 132, which interacts with a movable stop pin (not shown) mounted to protrude into the centre of the receiver 14. Depending on the length of a compatible casing, the stop track 132 may be formed closer to the bolt head 56 (for a shorter cartridge) or further from the bolt head 56 (for a longer cartridge). Thus the stop track 132 limits the stroke of the bolt 30 for ejecting and loading cartridges.

The breech sleeve 84 includes a forward outwardly projecting rim 134, which provides a limit to the distance that the breech sleeve 84 may be inserted into the flared portion 90 of the receiver 14. With additional reference to FIGS. 10-13, the barrel nut 16 clamps the breech sleeve rim 134 against the receiver 14 to hold the barrel 12 firmly attached to and aligned with the receiver 14. The barrel 12 includes the protruding pin 86 that mates into the matching slot 88 formed in the receiver 14 to ensure alignment of the feed ramp 82 to the feed slot 58. The pin 86 protrudes no further outward than an outer surface of the receiver 14, so as not to interfere with threading of the barrel nut 16.

Figure 10:
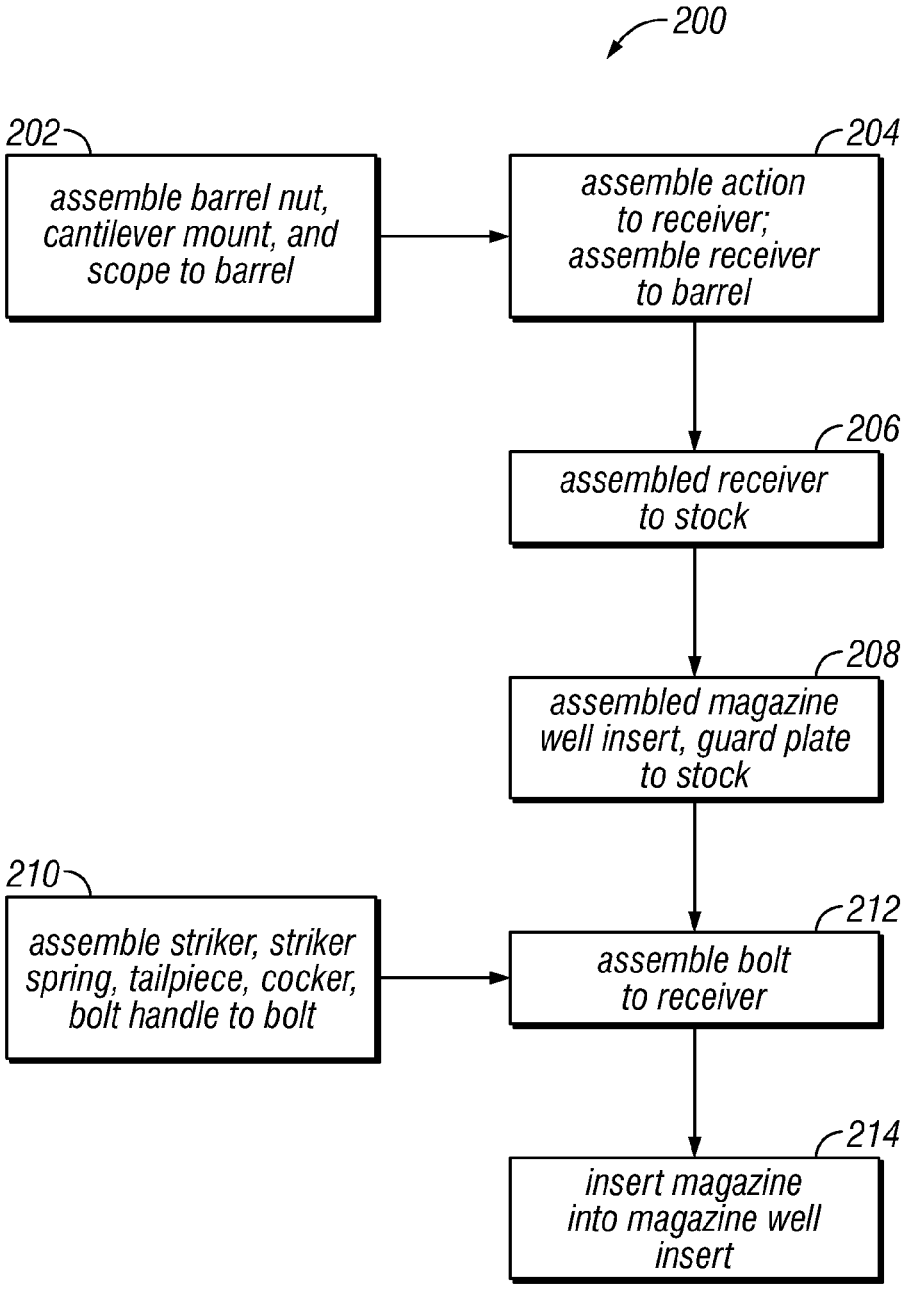
FIG. 10 is a flowchart illustrating the steps of a method for assembling the rifle shown in FIGS. 1-4.

FIG. 10 shows a series of steps for a method 200 of assembling the rifle 10, which are illustrated in FIGS. 11-18. The method 200 includes: step 202, assembling the removable barrel with the scope; step 204, attaching the receiver to the barrel; step 206, assembling the receiver and barrel sleeve to the stock; step 208, assembling the magazine insert and guard plate to the stock; step 210, assembling the bolt; step 212, assembling the bolt to the receiver; and step 214, inserting the magazine.

Figure 11:
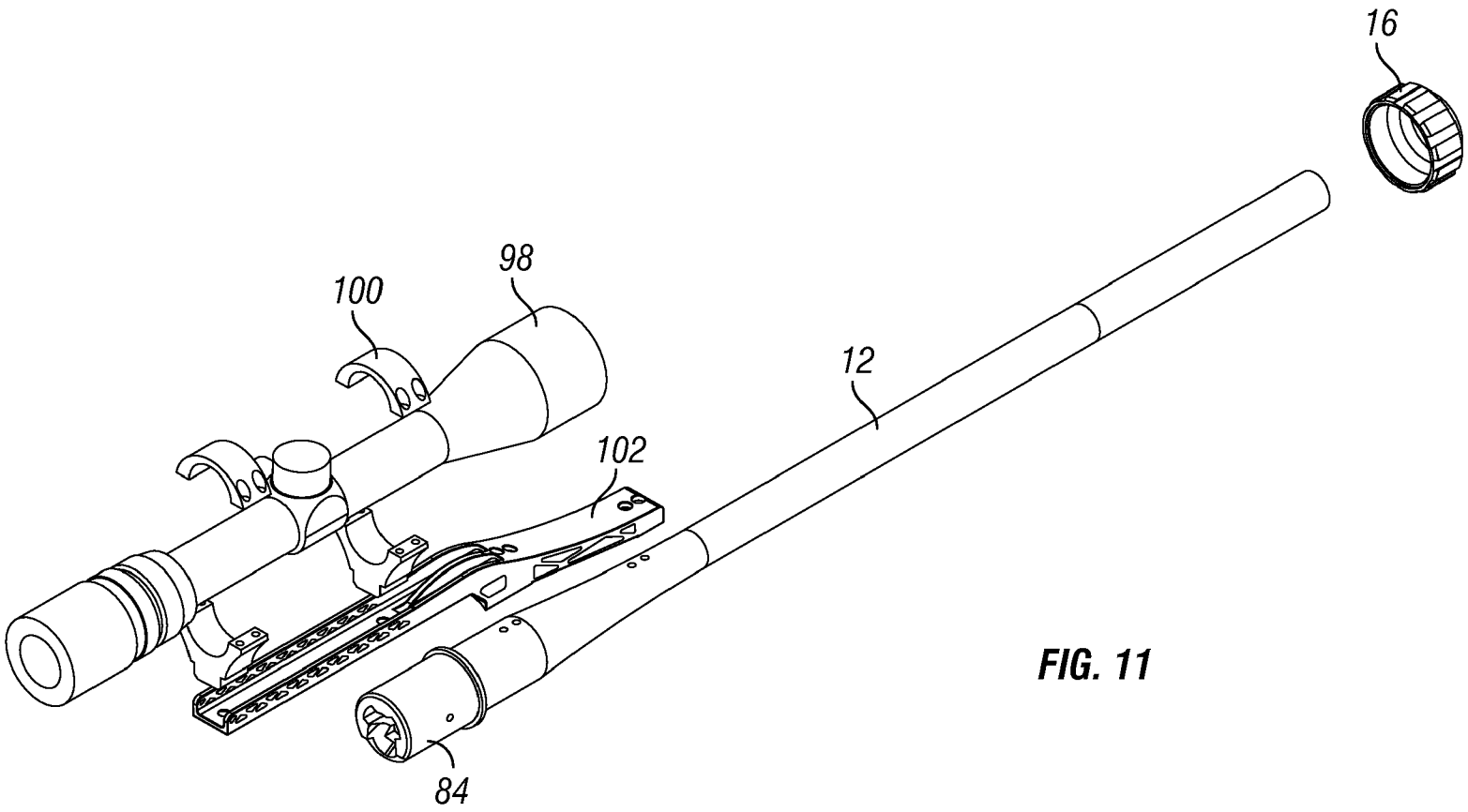
FIG. 11 is a perspective view of a step of assembling a collar nut, a cantilever scope mount, and a scope to a barrel having a breech sleeve attached thereto, thereby forming a barrel subgroup of the rifle shown in FIGS. 1-5.

In particular, FIG. 11 shows step 202 that includes assembling the barrel nut 16, the cantilever mount 102, the ring clamps 100, and the scope 98 onto the barrel 12. Initially, the barrel nut 16 is slid onto the barrel 12 from the muzzle end until the barrel nut 16 rests against the rim 134 of the breech sleeve 84. The cantilever mount 102 can then be screwed onto the barrel 12 to capture the barrel nut 16 between the mount 102 and the rim 134 of the breech sleeve 84. The scope 98 is attached to the mount 102 with ring clamps 100.

Figure 12:
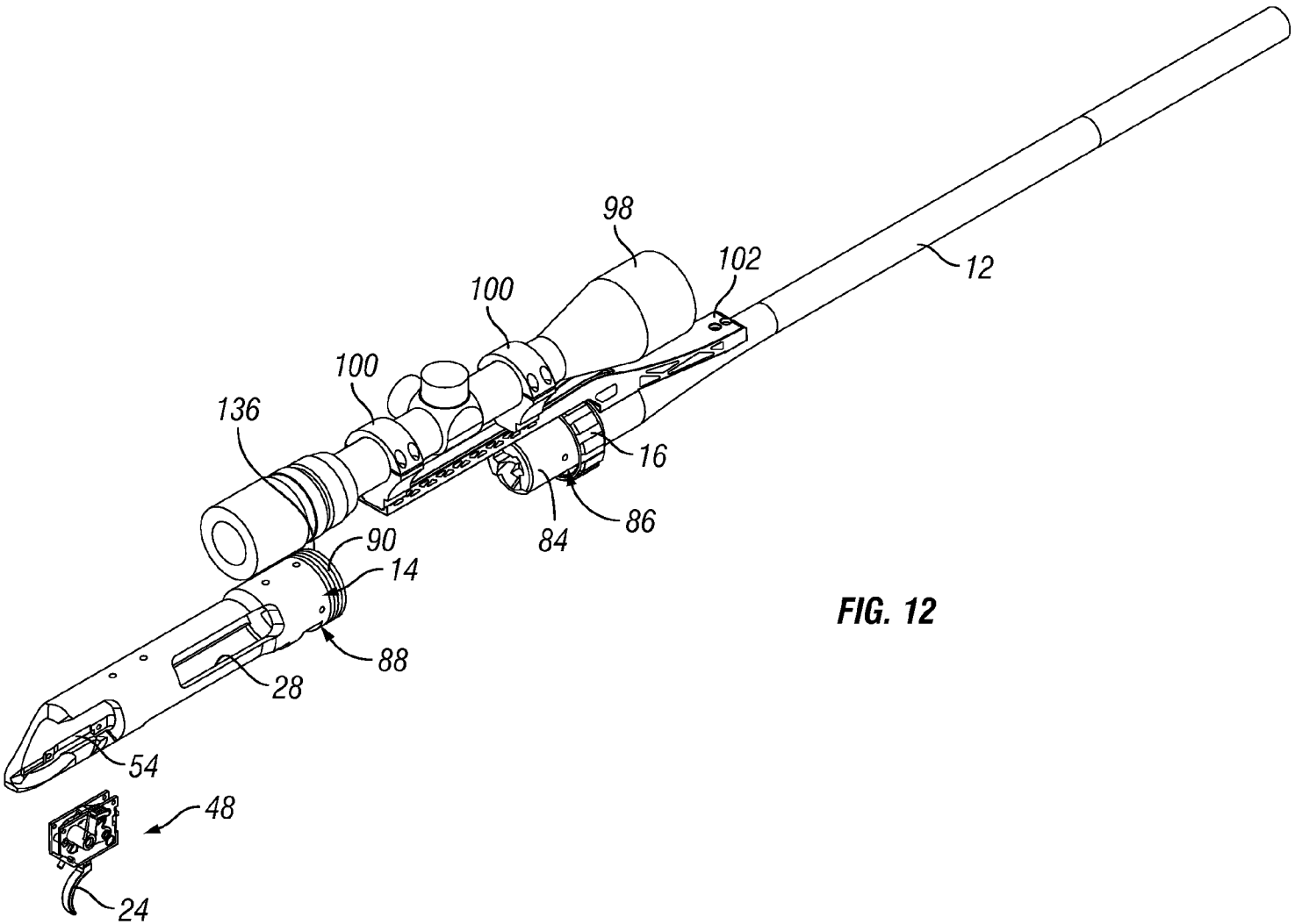
FIG. 12 is a perspective view of a step of assembling a receiver to the barrel subgroup shown in FIG. 11, and assembling an action to the receiver, thereby forming an upper assembly of the rifle shown in FIGS. 1-7.

FIG. 12 shows step 204 that includes assembling the receiver 14 to the barrel 12, and assembling the action 48 to the receiver 14, thereby forming an upper assembly of the rifle 10. In particular, the barrel 12 is assembled to the receiver 14 by inserting the breech sleeve 84 into the flared portion 90 of the receiver 14, with pin 86 sliding into slot 88 to align the breech sleeve 84 to the receiver 14. Then the barrel nut 16 is threaded onto external threads 136 formed at the forward end of the receiver 14 about flared portion 90. Rotation of the barrel nut 16 attaches the breech sleeve rim 134 to the receiver 14. For adequate preload, a barrel wrench 300 and a V-bolt handle 400 may be used as further discussed below with reference to FIG. 20. For enhanced engagement of the barrel wrench 300, the barrel nut 16 includes dovetail grooves 138, as further discussed below with reference to FIG. 20. Before or after attaching the barrel 12, the action 48 is fastened to the receiver 14 with the sear 52 protruding up through the sear slot 54. Assembly of the action 48 may be omitted for changing the barrel of an otherwise assembled rifle.

Figure 13:
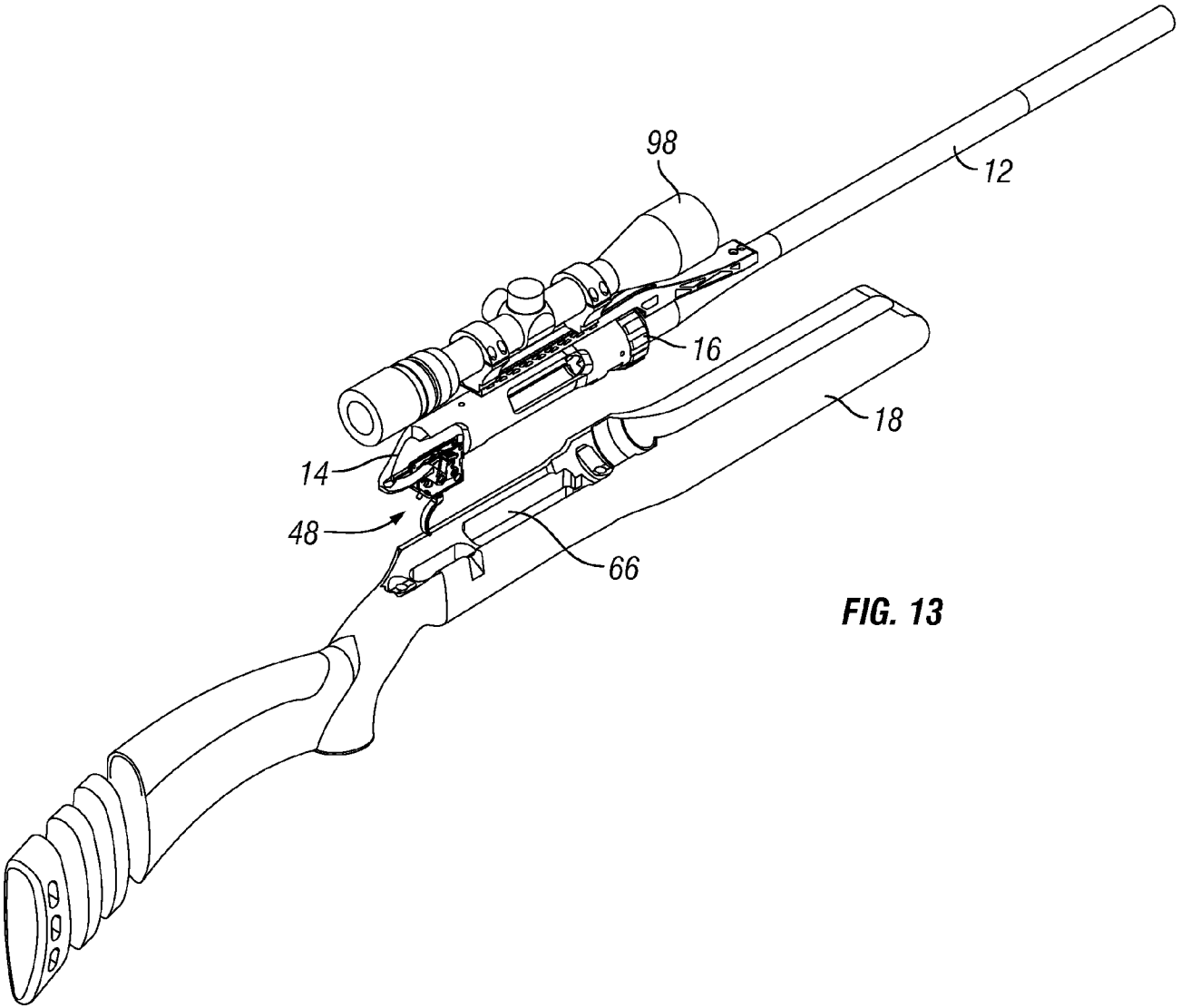
FIG. 13 is a perspective view of a step of assembling a stock to the upper assembly shown in FIG. 12.
Figure 14:
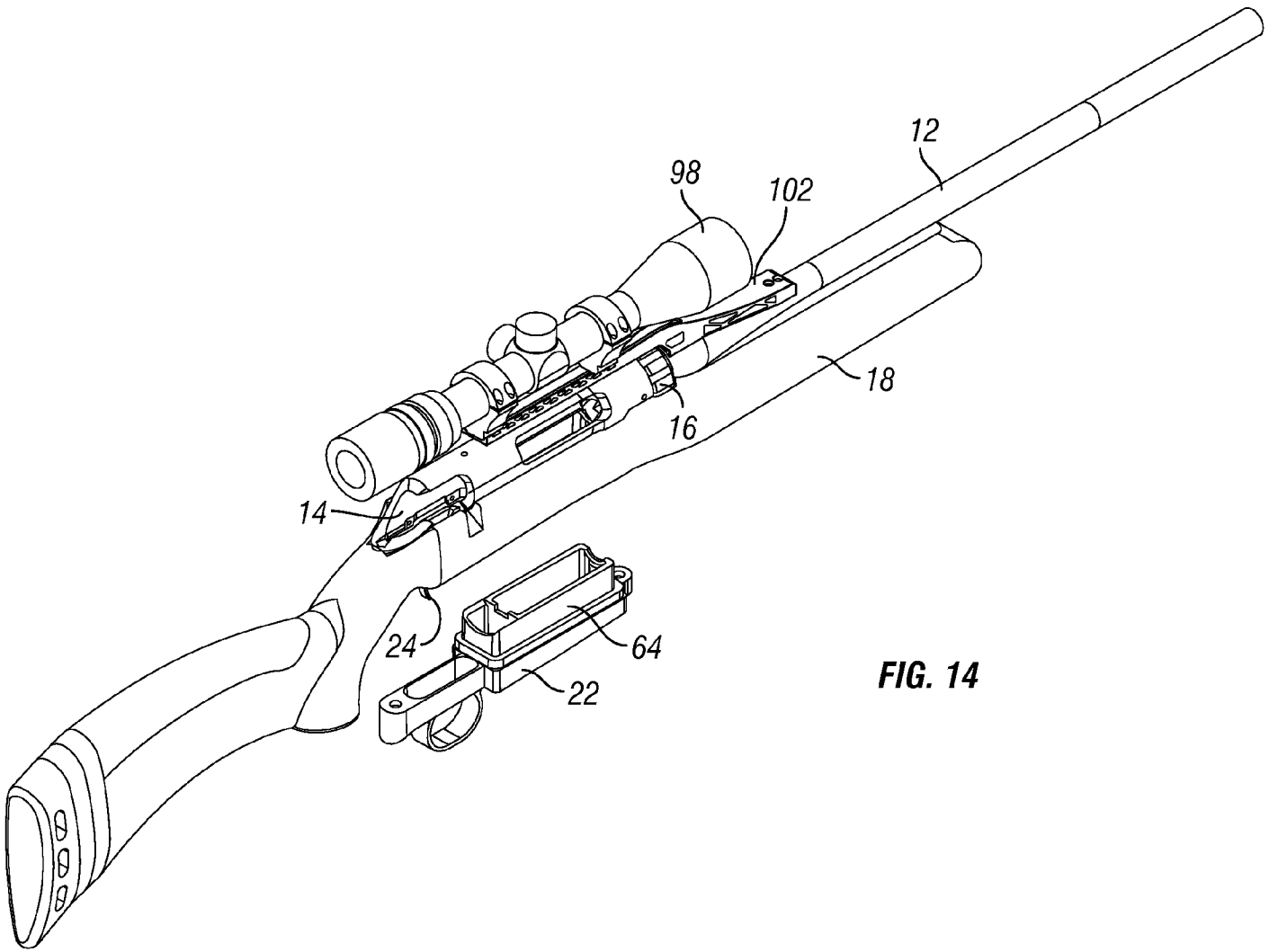
FIG. 14 is a perspective view of a step of assembling a magazine well insert and a guard plate to the stock and the upper assembly shown in FIG. 13.

FIGS. 13 and 14 show in perspective view steps 206 and 208 that includes assembling the receiver 14, the magazine well insert 78, and the guard plate 22 to the stock 18. As discussed above, different sizes of magazine well inserts 64 are provided to accommodate different magazines 62, according to the lengths and diameters of cartridges to be held in each magazine 62. Each magazine well insert 64 is dimensioned to appropriately locate a compatible magazine 62 within the one-size magazine well 66 formed in the stock 18, such that a compatible cartridge may be smoothly swept by the compatible bolt 30 from the magazine tray 52 up the feed ramp 82 and into the chamber 80 of the compatible barrel 12.

Figure 15:
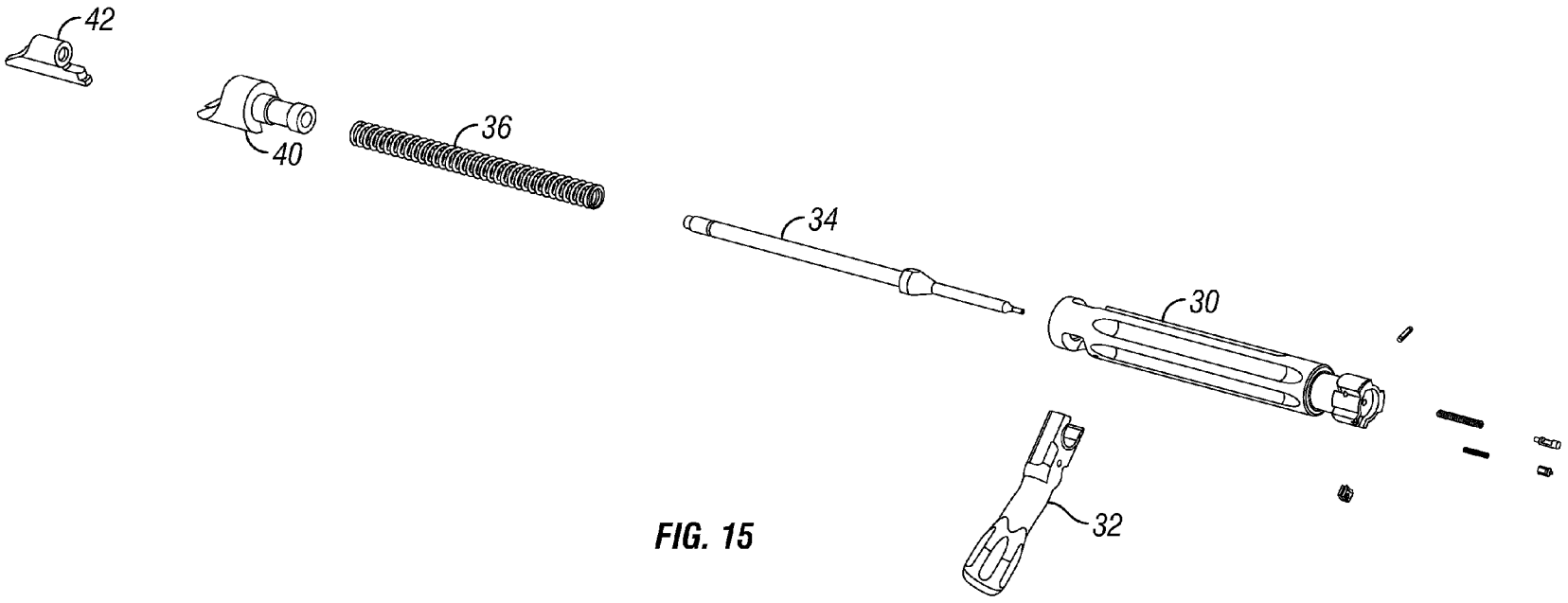
FIGS. 15 and 16 are perspective views of a step of assembling a striker, a striker spring, a tailpiece, a cocker, a sleeve, and bolt handle, thereby forming a bolt group.
Figure 16:
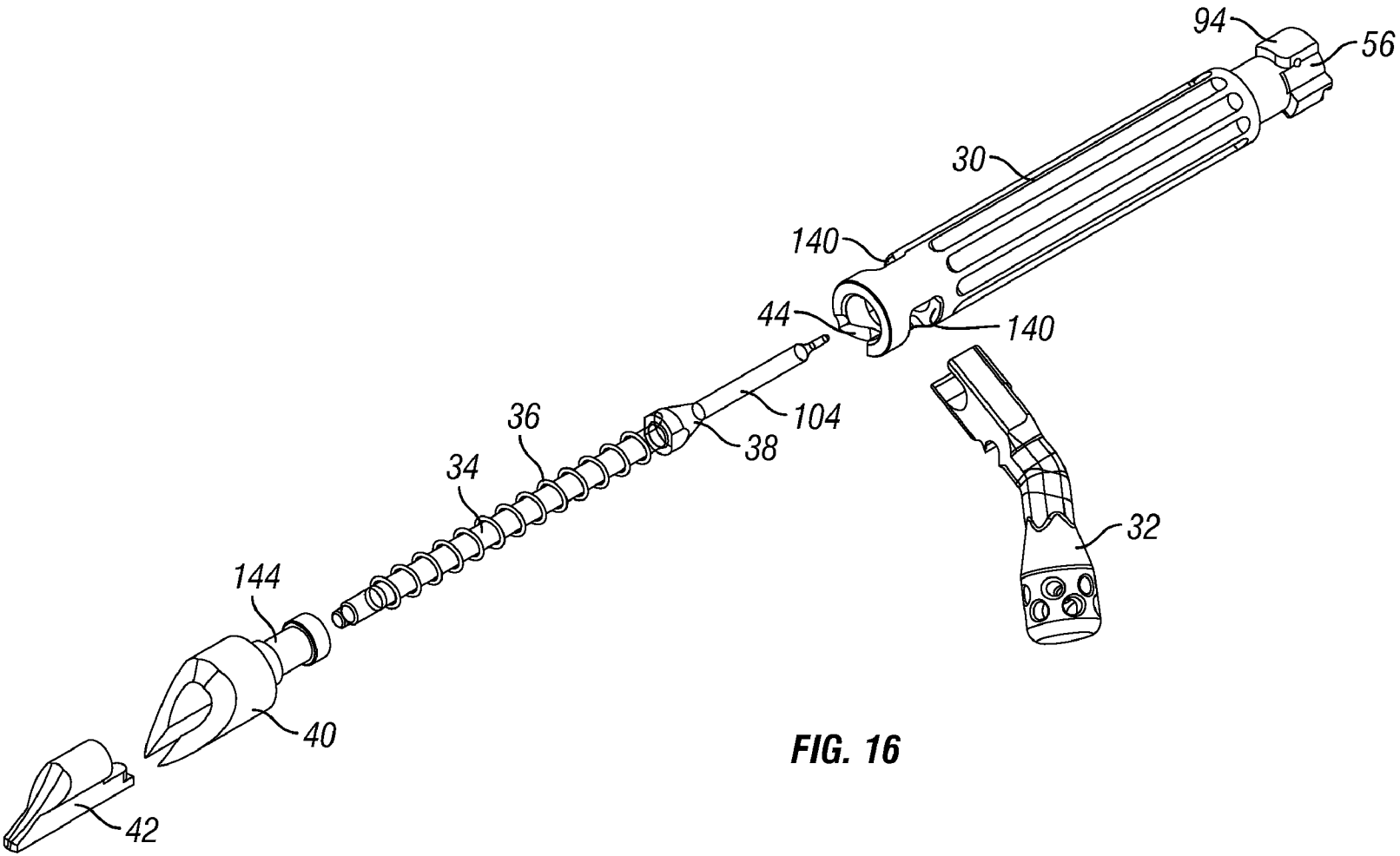

FIGS. 15 and 16 show step 210 that includes assembling the striker 34, the striker spring 36, the tailpiece 40, the cocker 42, the bolt 30, and the bolt handle 32 to form a bolt group. The striker spring 36 is placed over the striker 34 rearward of the plunger 38, the tailpiece 40 is slid over the threaded tail of the striker 34, and the cocker 42 is threaded onto the threaded tail of the striker 34. The tailpiece 40 is then pulled back over the cocker 42. Then the striker 34 and the tailpiece 40 are inserted into the rearward end of the bolt 30, so that the plunger 38 and the tailpiece 40 align the striker pin 68 with the orifice 70. The bolt handle 32 is slipped through slots 140 formed in the bolt 30 and is attached by a pin (not shown) in engagement with a circumferential groove 144 formed on the tailpiece 40, thereby capturing the tailpiece 40, striker 34, striker spring 36, and cocker 42 in the bolt 30. At the head of the bolt 30, an ejector spring and pin and an extractor claw (not shown) are fastened to the bolt 30, so as to complete the step 210 of assembling the bolt group.

Figure 17:
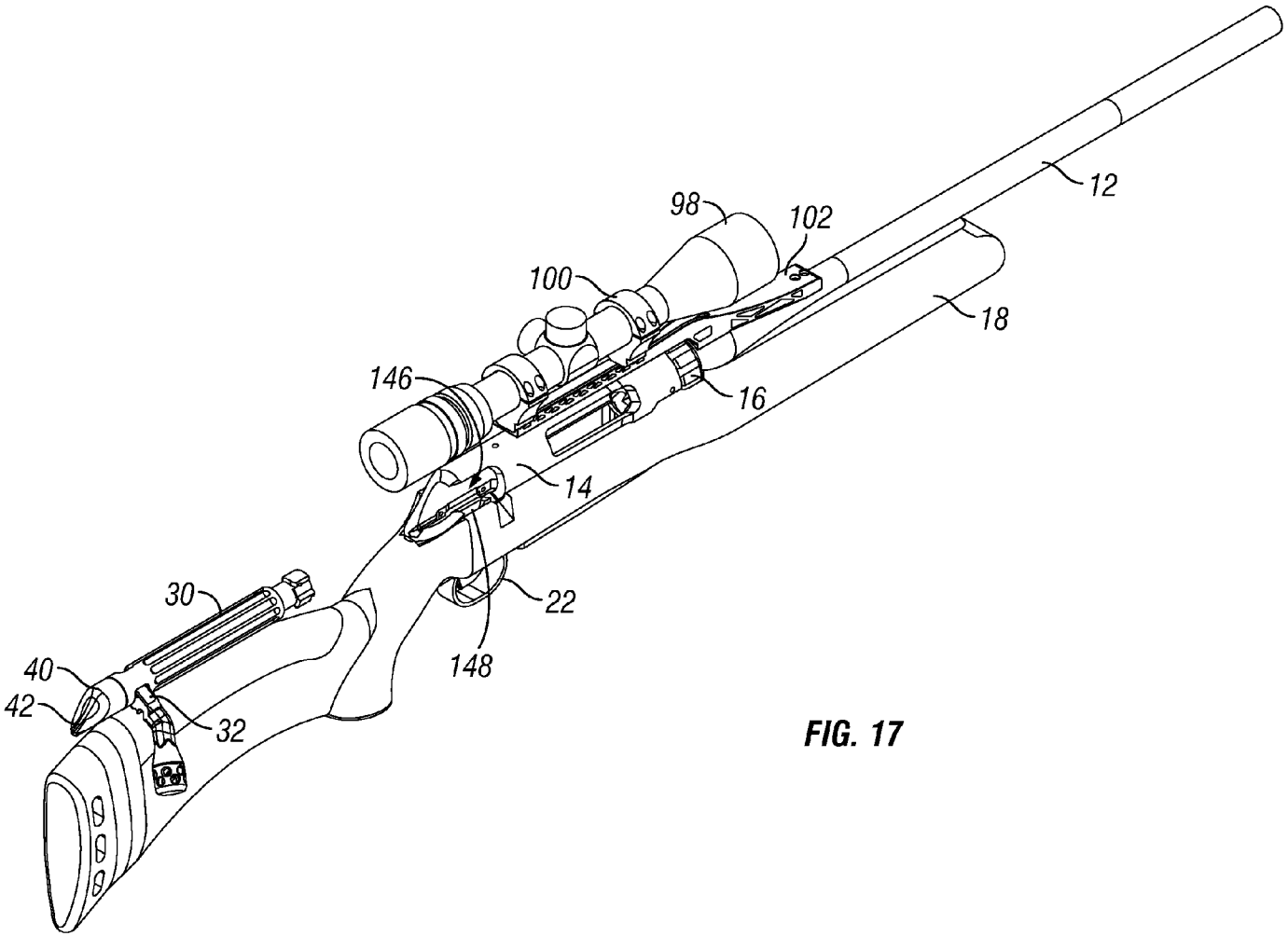
FIG. 17 is a perspective view of a step of assembling the bolt group shown in FIGS. 15 and 16 to the assembly shown in FIG. 14, thereby forming the rifle shown in FIGS. 1-7.

FIG. 17 shows step 212 that includes assembling the bolt 30 into the receiver 14 to complete the rifle 10. With the bolt handle 32 aligned to a bolt slot 146 extending along the side of the receiver 14 just above a safety notch 14 in the stock 18, the bolt 30 is slid forward into the receiver 14 until the bolt lugs 94 pass between the lands 96 formed in the breech sleeve 84. The bolt handle 32 then is rotated down to lock the bolt head 56 into the breech sleeve 84.

Figure 18:
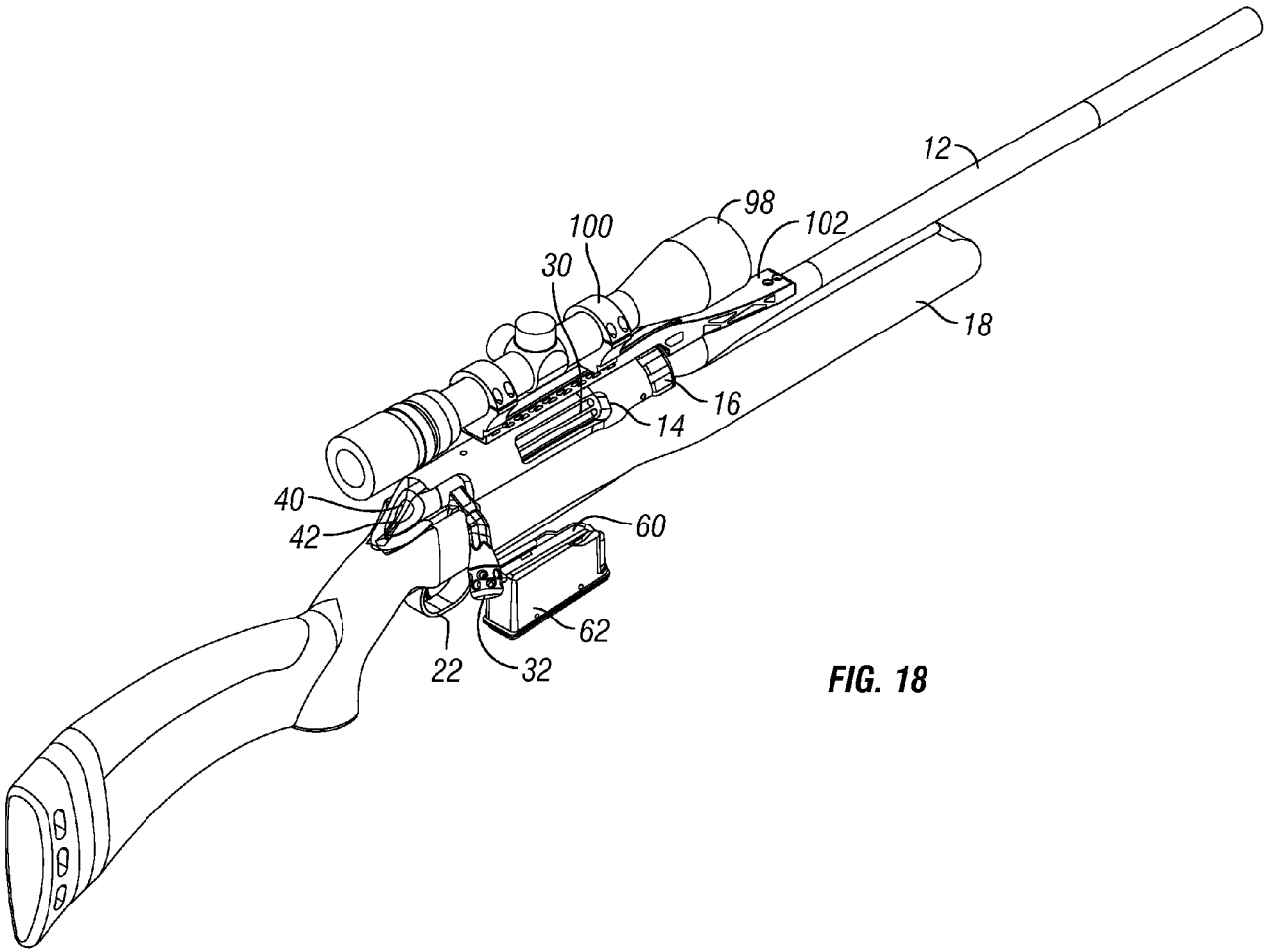
FIG. 18 is a perspective view of a step of inserting a magazine into the rifle shown in FIG. 17.

FIG. 18 shows step 214 that includes inserting the magazine 62 into the magazine well insert 78 until the magazine catch 80 clicks into place above the guard plate 22. The rifle 10 now is in a locked, unloaded condition.

Figure 20:
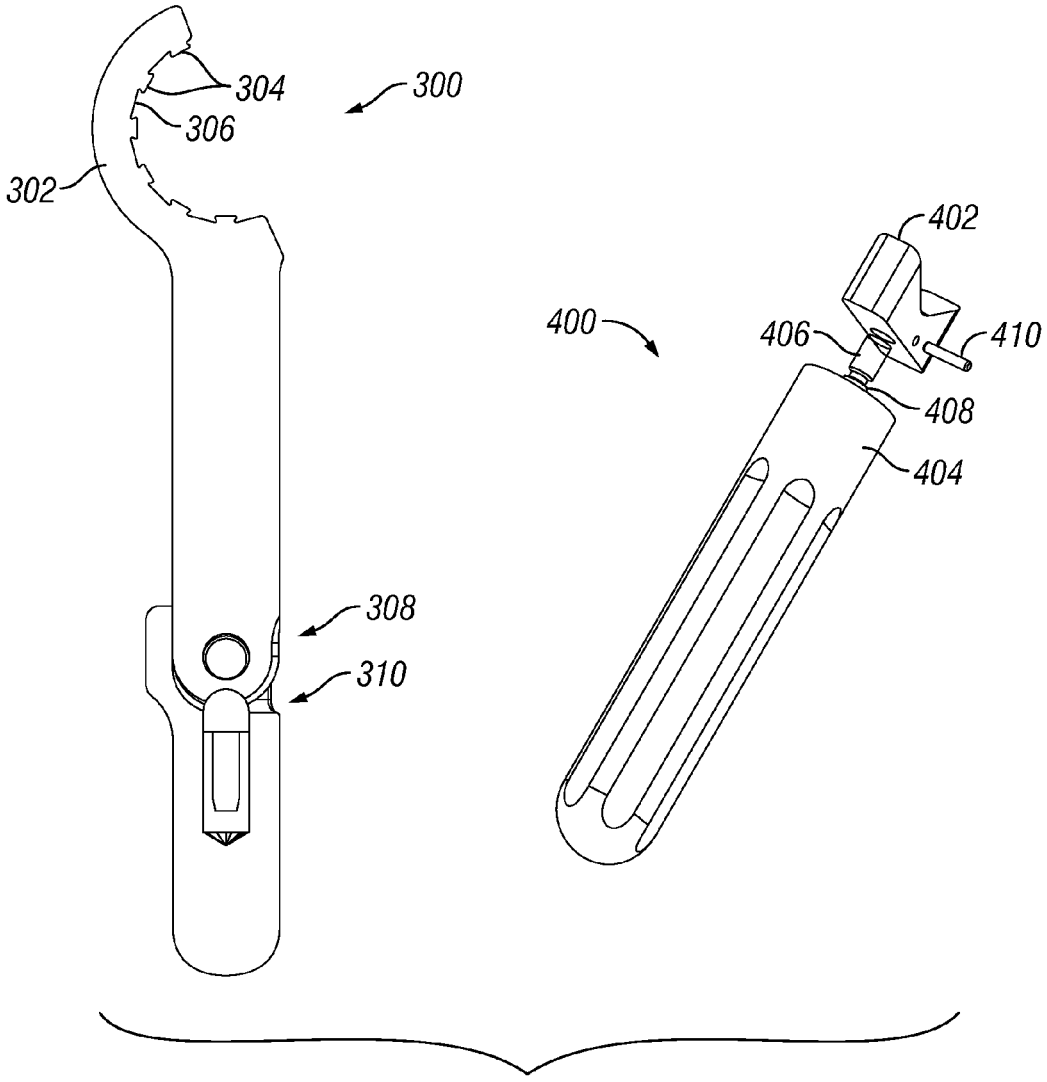
FIG. 20 is a side section view of tools for use in removing or attaching the barrel subgroup from or to the receiver as shown in FIG. 8.

FIG. 20 shows in side section view of a pre-set barrel wrench 300 and a V-block bolt handle 400. The barrel wrench 300 includes a spanner 302 with teeth 304 having dovetail flanks 306 that mate to the dovetail grooves 138 formed on the barrel nut 16. Engagement of the mating dovetails prevents slippage of the barrel wrench, precludes marring of the barrel nut 16 or of the barrel wrench 300, and thereby prolongs the usable lives of these components. Additionally, the dovetails permit use of softer material for fabrication of the barrel wrench 300 (such as, by way of example, a nylon or phenolic plastic) and for the barrel nut 16 (such as, by way of example, aluminum). The barrel wrench 300 also includes a bolt handle 308 with a spring-detent pivot 310 that is pre-set to pop and permit hinging of the barrel wrench bolt handle when the barrel nut 16 has been adequately torqued. The V-block bolt handle 400 includes a V-head 402 for engaging with the indents 122 formed in the breech sleeves 84, and a grip 404 for manipulating the V-head 402. The grip 404 includes a threaded fastener 406, which has a groove 408 formed around its circumference. The V-head 402 is rotatably pinned to the grip 404 by engagement of a pin 410 into the groove of the threaded fastener 406.

During use of the barrel wrench 300 and the V-block bolt handle 400 for disassembling a barrel 12 from a receiver 14, an operator first removes the barrel 12 and the receiver 14 from the stock 18 using the reverse order of assembly steps discussed above. The operator then inserts the V-head 402 through the cutout portion 120 of receiver 14 and into the indents 122 formed in the breech sleeve 84, and turns the grip 404 to thread the fastener 406 into the tapped hole 125 provided in the breech sleeve 84 for connecting the barrel 12 to the stock 18. Once the V-block bolt handle 400 has been secured to the breech sleeve 84, the operator engages the dovetailed teeth 304 of the barrel wrench 300 with the dovetail grooves 138 of the barrel nut 16. The operator then prevents the rotation of the barrel 12 and the receiver 14 using the V-block bolt handle 400, and uses the barrel wrench 300 to loosen and remove the barrel nut 16 in a manner apparent to the skilled worker. Assembly is essentially the reverse of disassembly.

Figure 21:
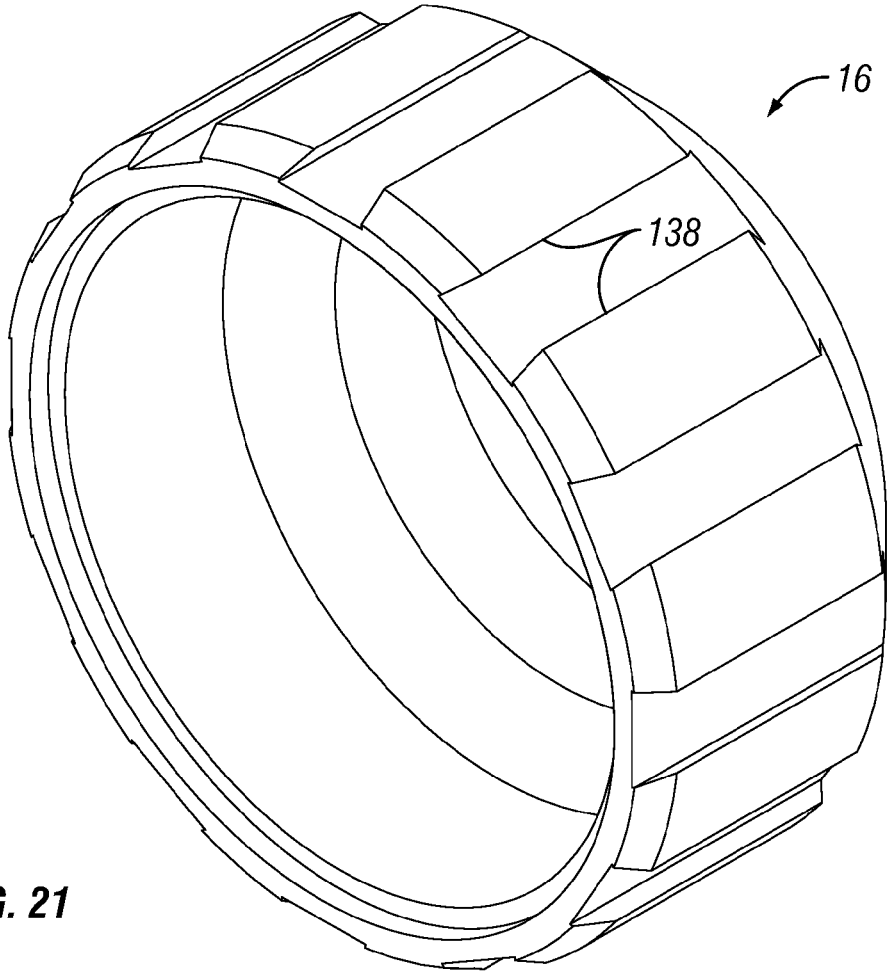
FIG. 21 is a perspective view of the barrel nut of the rifle shown in FIGS. 1-7.
Figure 22:
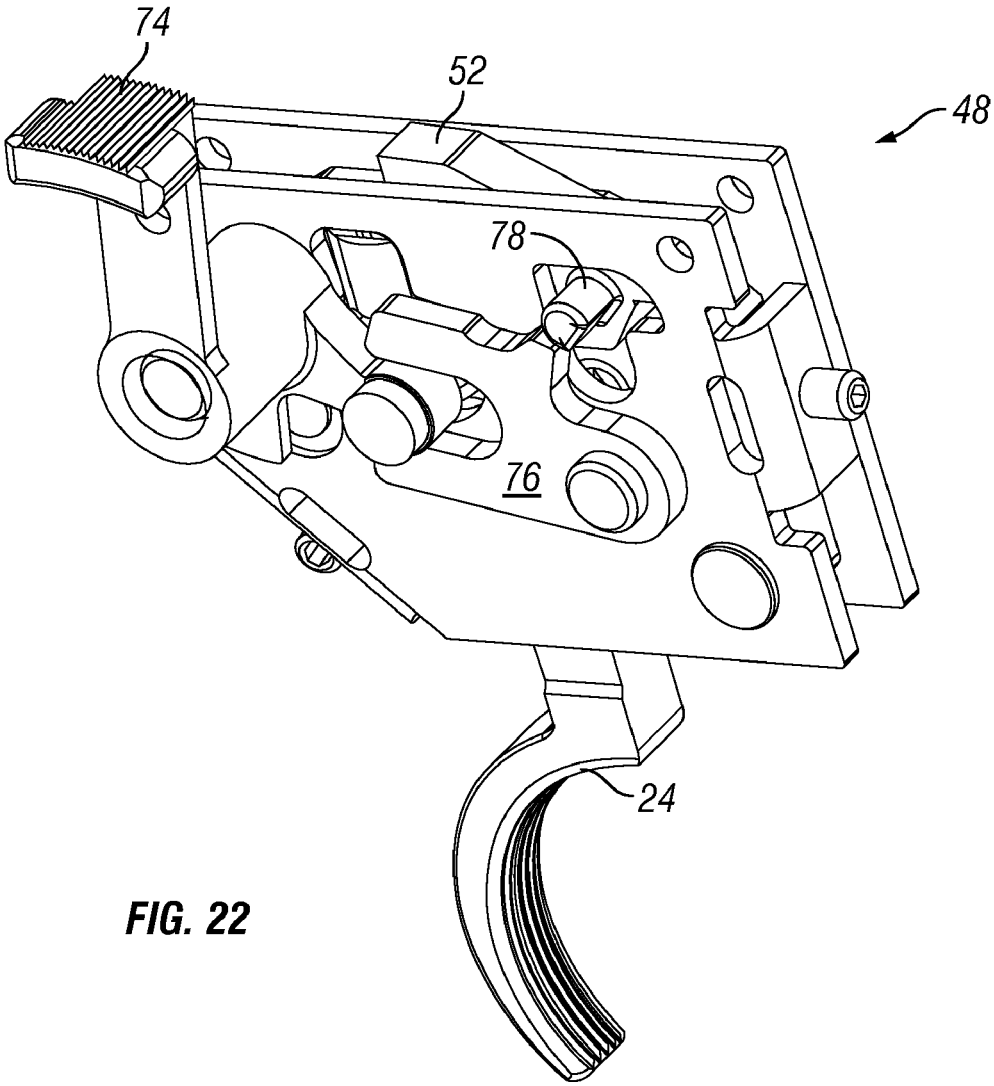
FIG. 22 is a perspective view of the action of the rifle shown in FIGS. 1-7.
Figure 23:
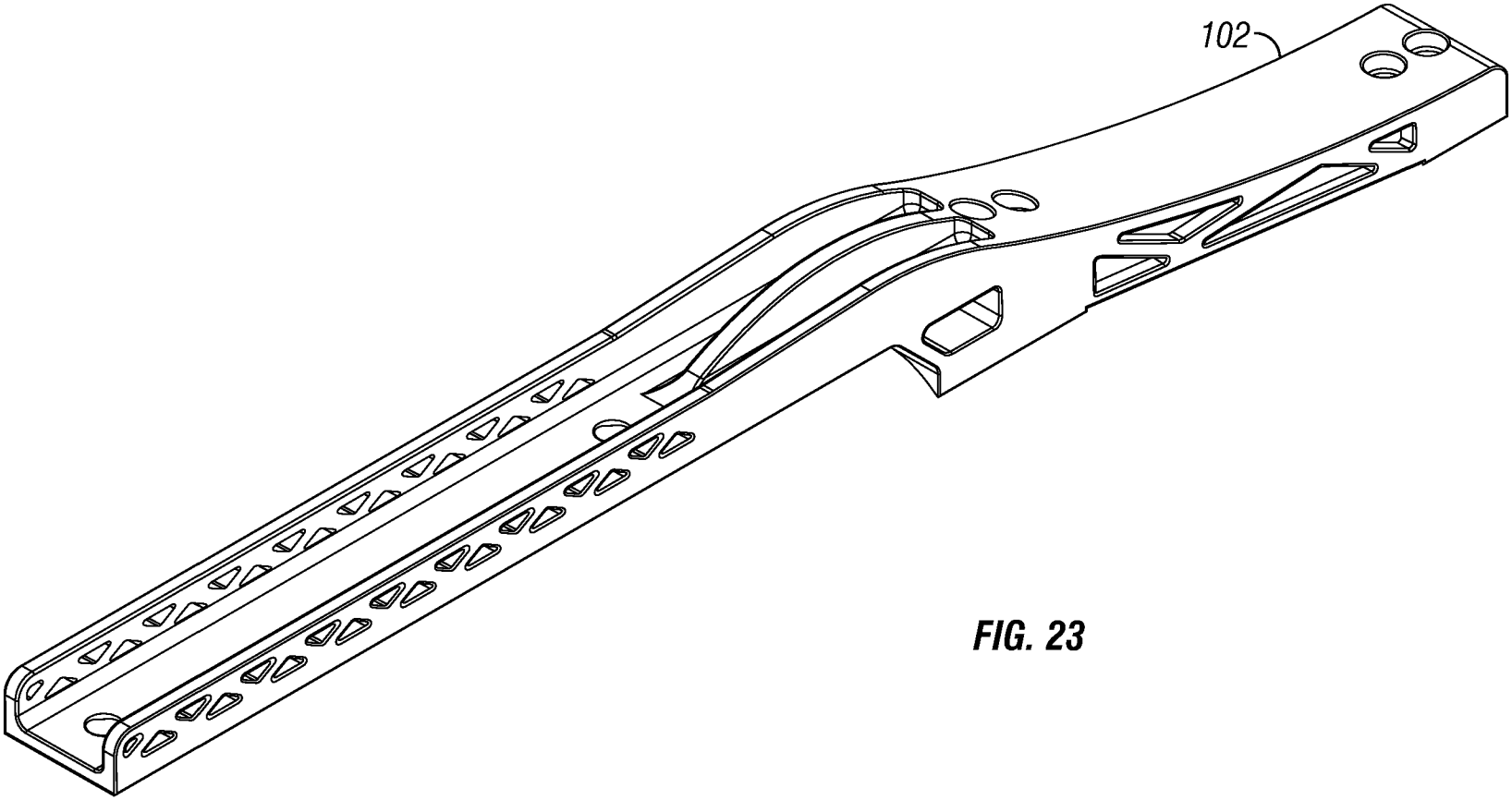
FIG. 23 is a perspective view of the cantilevered scope mount of the rifle shown in FIGS. 1-7.

FIG. 21 is a perspective view of the details the barrel nut 16. FIG. 19 is a bottom perspective view of the receiver 14 showing the slot 88 for receiving pin 86, as well as a hole 150 for slidingly receiving the movable stop pin (not shown) that extents into the stop track 132 in the bolt 30, discussed above with reference to FIG. 9. FIG. 22 shows in detail the action 48. FIG. 23 shows in detail the cantilever mount 102.

Figure 24:
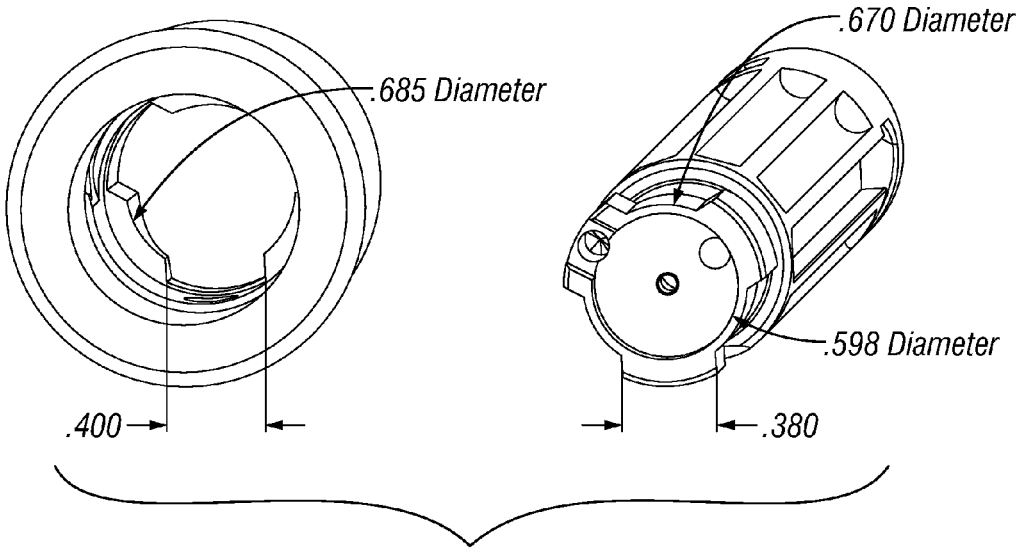
FIGS. 24-26 are perspective views of various possible bolt and breech sleeve dimensions.
Figure 25:
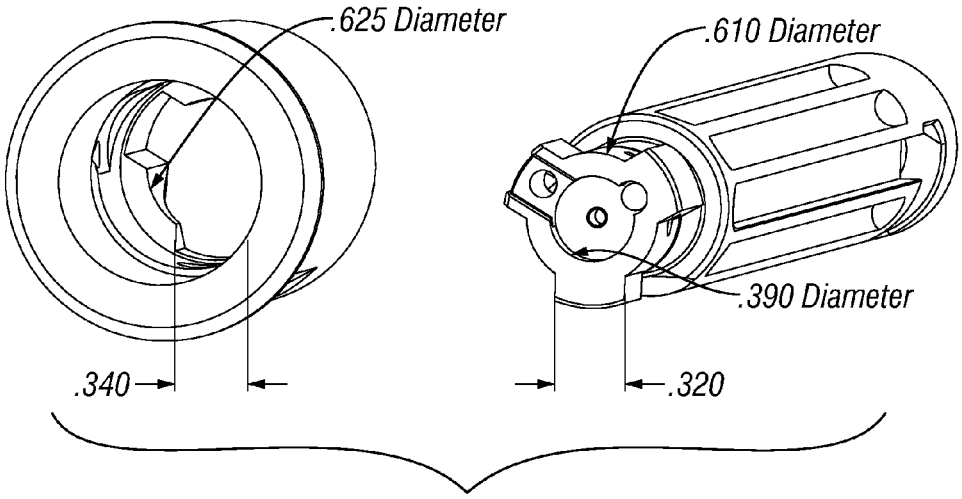
Figure 26:
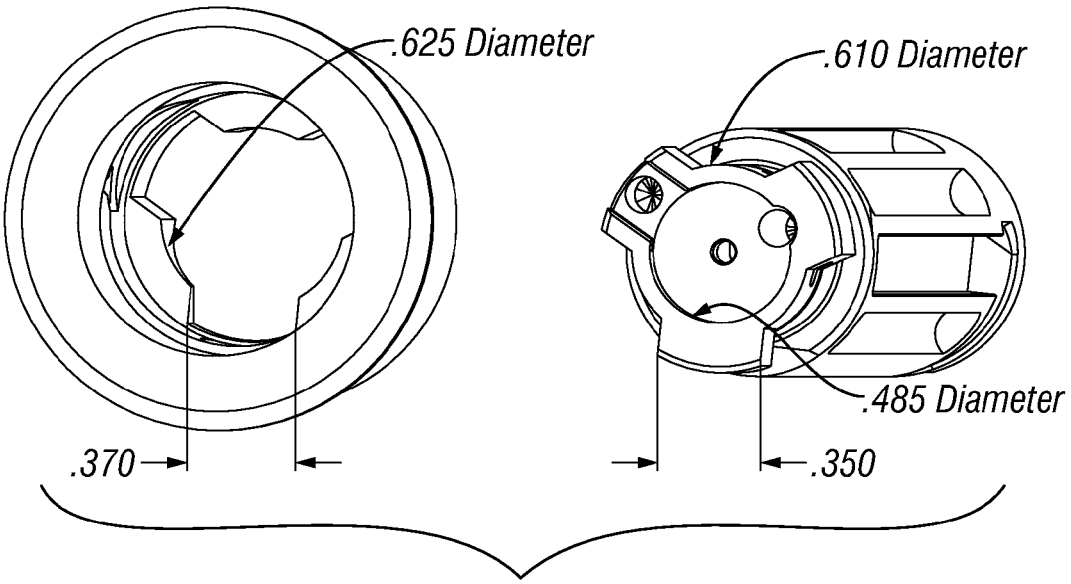
Figure 27:
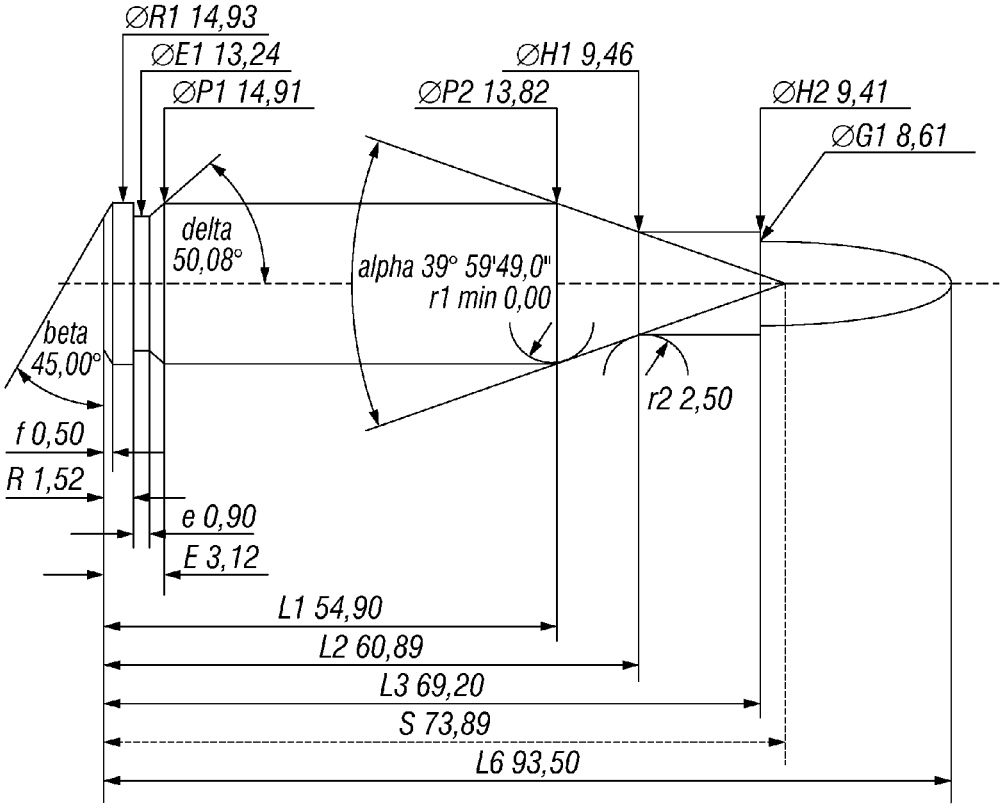
FIGS. 27-30 are section views of various possible cartridge dimensions.
Figure 28:
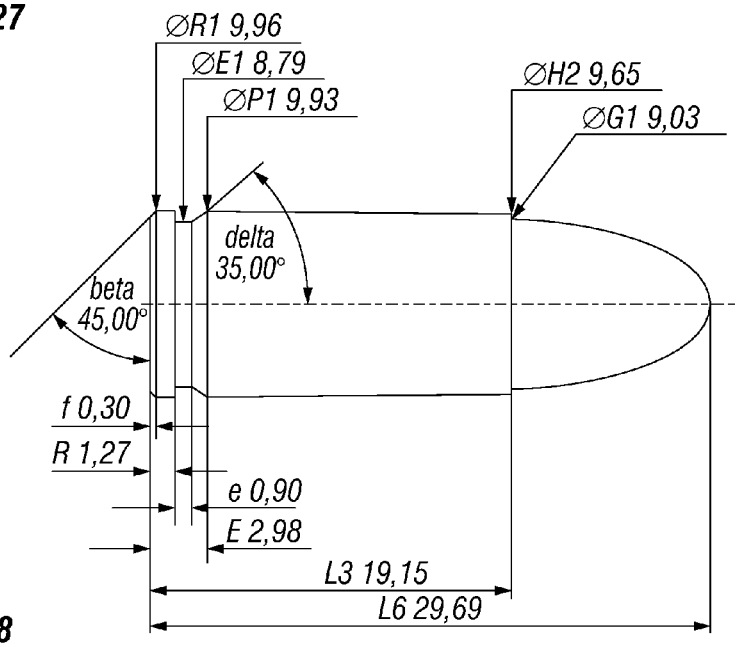
Figure 29:
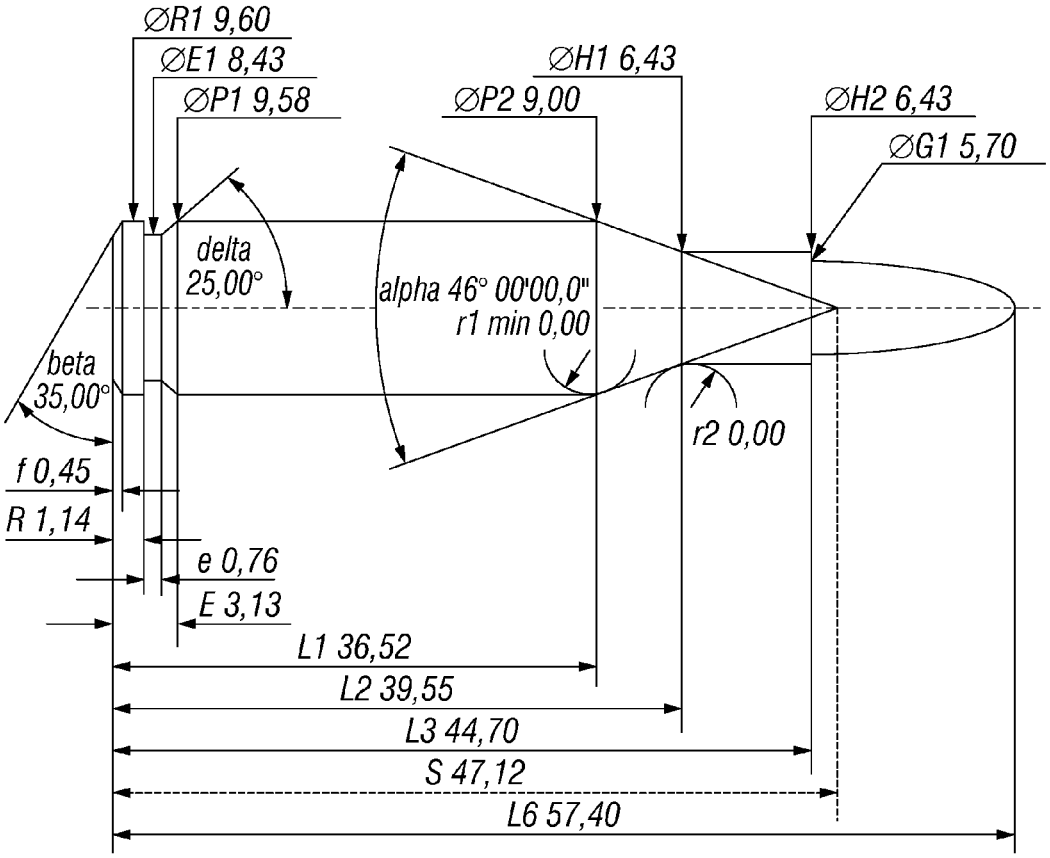
Figure 30:
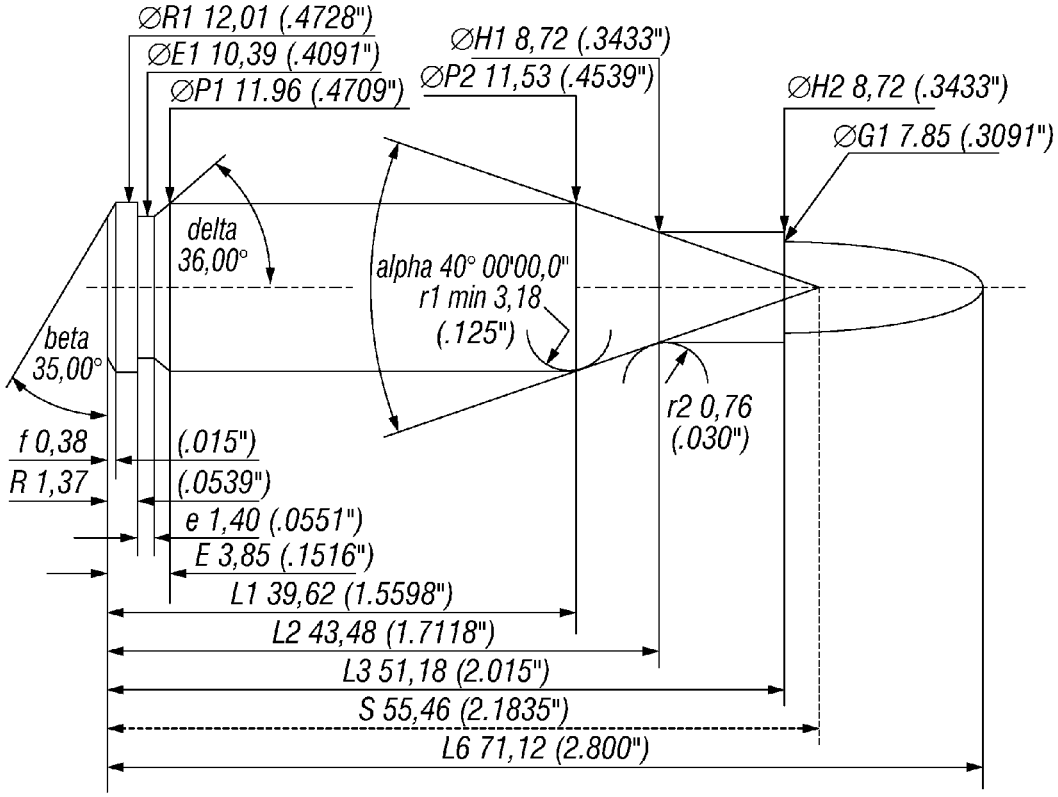

FIGS. 24-26 show in detail various bolt head and breech sleeve configurations suitable for use with various cartridges. Dimensions shown are exemplary and merely illustrate possible variations in bolt head dimensions for the purpose of bolt-to-barrel matching. In addition to varying lug and groove diameters and widths, the lengths of lugs and the depths of grooves may also be varied to preclude locking a mismatched bolt and breech. As an unlocked bolt prohibits the trigger from releasing the cocker and striker, the present invention thereby provides an additional safety interlock.

FIGS. 27-30 show, by way of non-limiting examples, various cartridges that may be used with the disclosed embodiments of the multi-caliber rifle 10. FIGS. 27-30 include publicly available metric dimensional data, for which no voucher of accuracy is made, to illustrate the possible variety of cartridge sizes and configurations.

One advantage of the present invention is that by providing matching lugs and grooves, it is possible to provide a matched set of bolt and barrel corresponding to particular calibers and casing sizes. Such matched sets can be stored with the bolt head locked in the breech sleeve. Further, bolts and barrels from different sets cannot be locked together or easily confused because the lugs of the bolt head and the grooves of the breech sleeve do not fit. Thus, the present invention precludes mis-assembly of bolts and barrels for disparate calibers or casing sizes, and prevents easily packing a mis-matched set for a long and expensive trip.

Additionally, the barrel-and-scope subassembly permits sighting in a scope for each interchangeable barrel and then removing the barrel for later use without the need to realign the scope the barrel.

Figure 31:
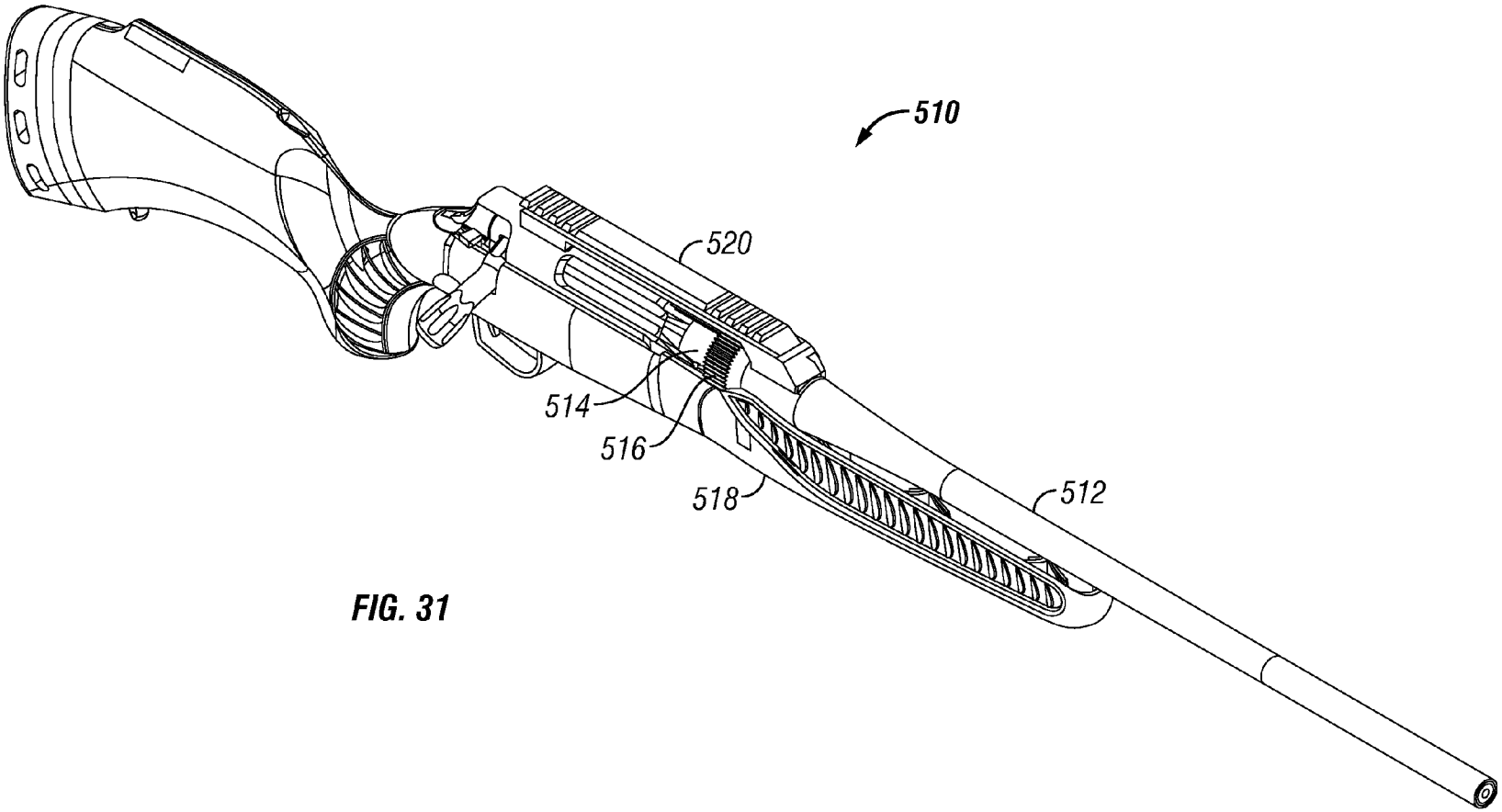
FIG. 31 is a forward perspective view of another embodiment of a multi-caliber bolt-action rifle in a cocked, locked, and safe condition according to an embodiment of the present invention.
Figure 32:
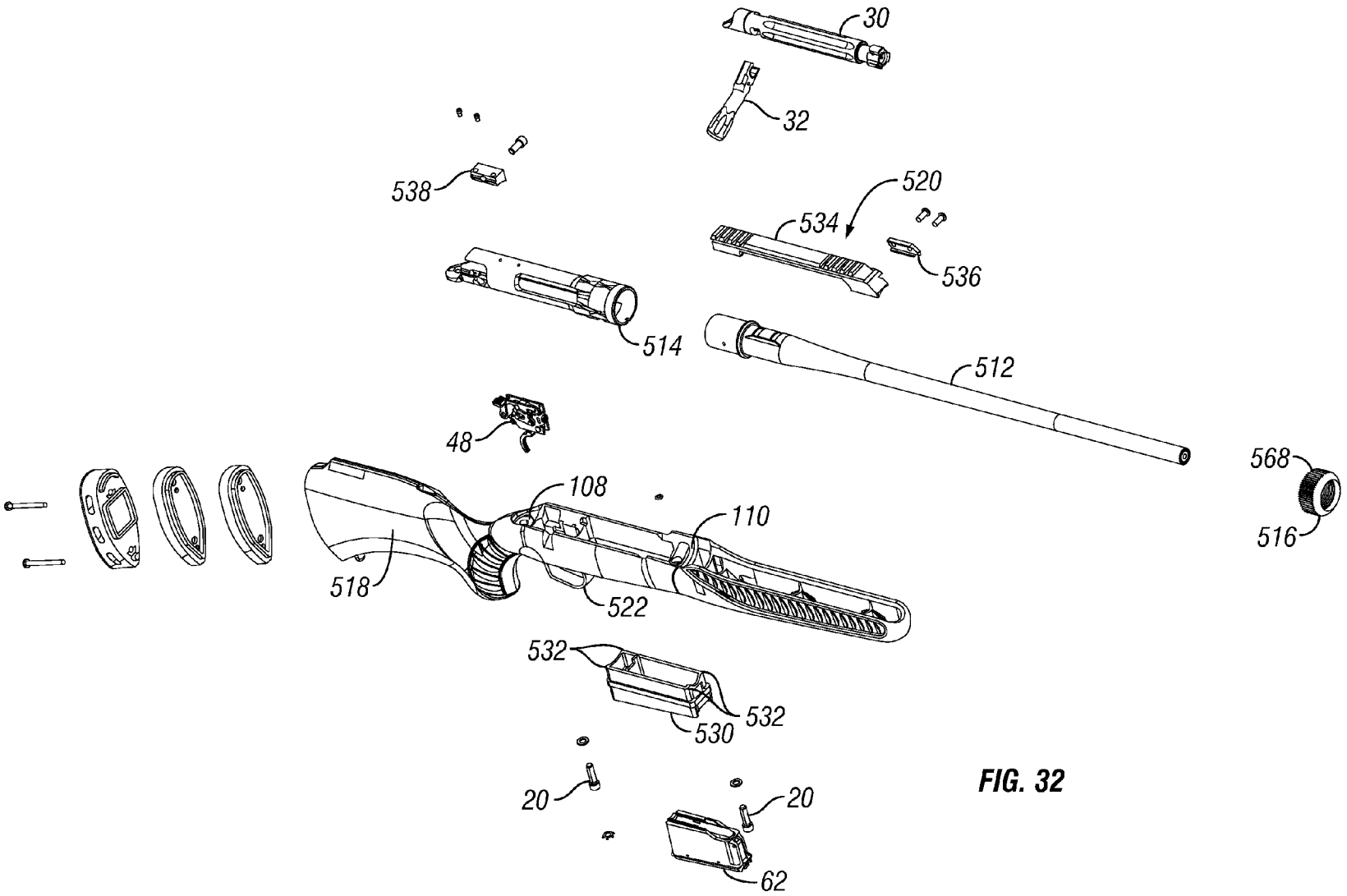
FIG. 32 is an exploded view of a teardown of the rifle shown in FIG. 31.

Another embodiment of a multi-caliber bolt-action rifle 510, in accordance with the present invention, is shown in FIGS. 31-32, wherein similar components are numbered similarly to like components shown in FIGS. 1-19. The rifle 510 includes a barrel 512 connected to a receiver 514 with a barrel nut 516. The receiver 514 is connected with the stock 518. Unlike the cantilever scope mount 102, rifle 510 has a scope mount 520 that is attached at a forward position to the barrel 512 and at a rearward position to the receiver 516.

Figure 33:
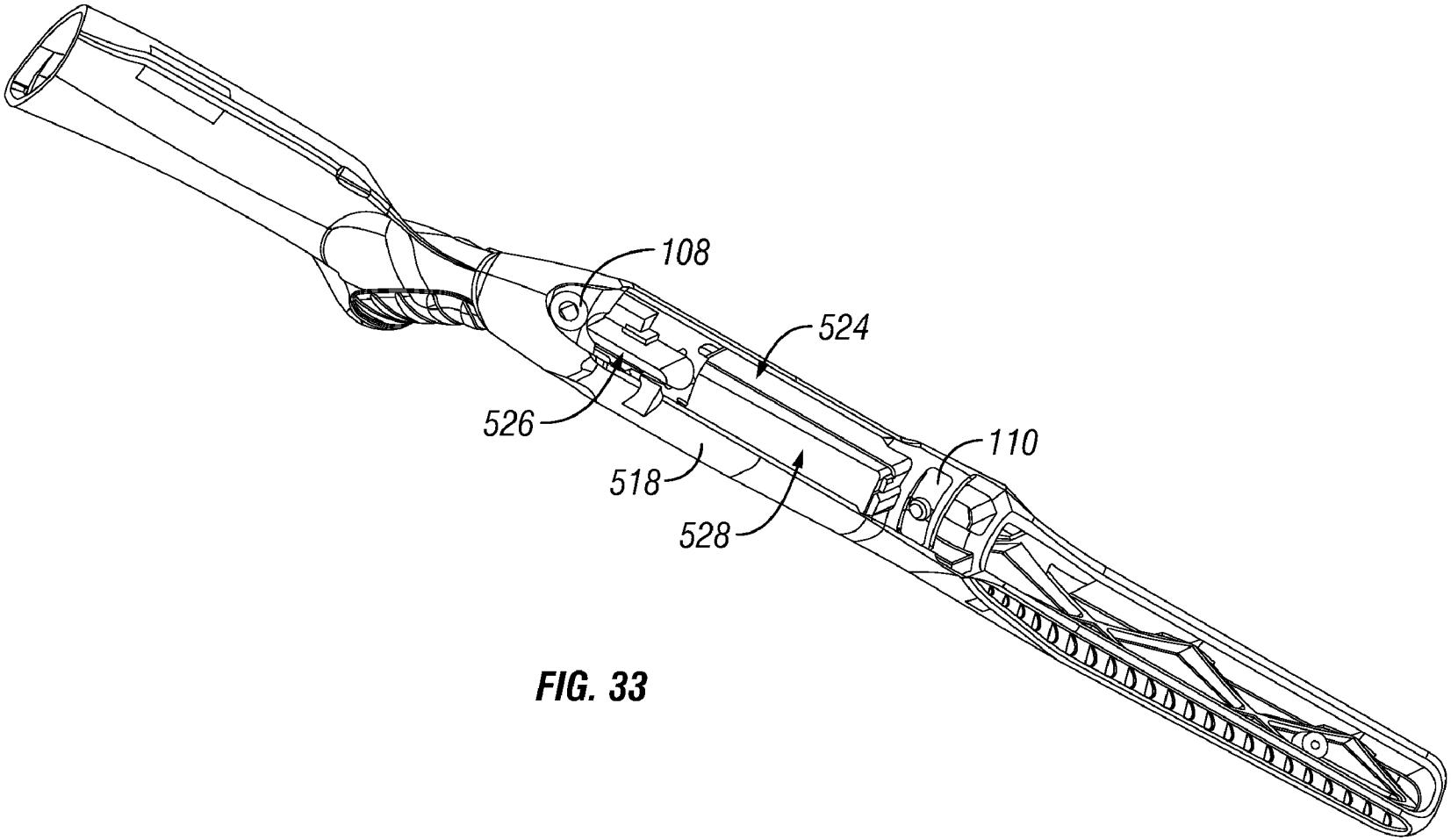
FIG. 33 is a top perspective view of a stock as shown in FIGS. 31 and 32.
Figure 34:
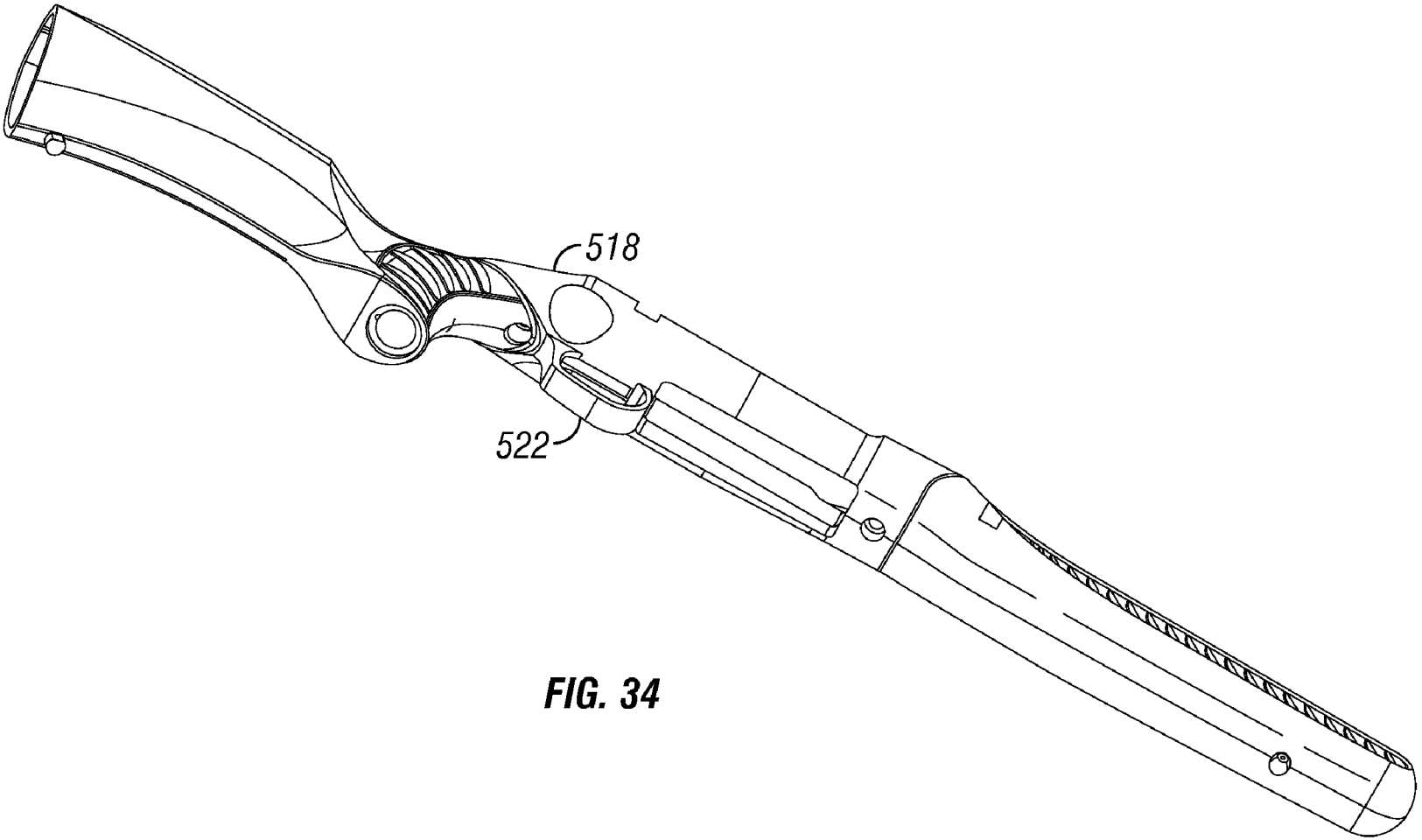
FIG. 34 is a bottom perspective view of the stock shown in FIGS. 31-33.
Figure 35:
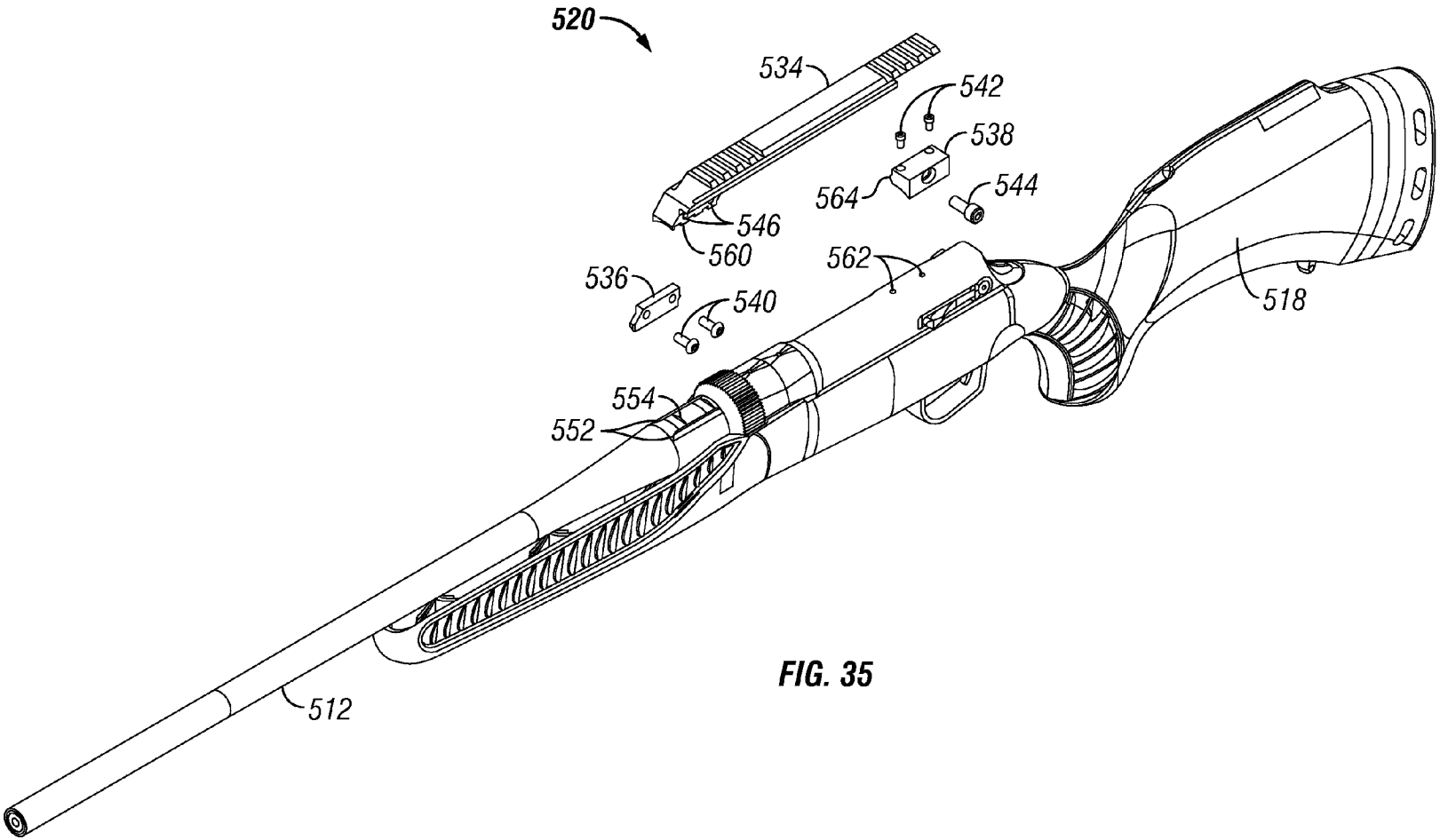
FIG. 35 is an exploded view of a scope mount as shown in FIGS. 31 and 32.
Figure 36:
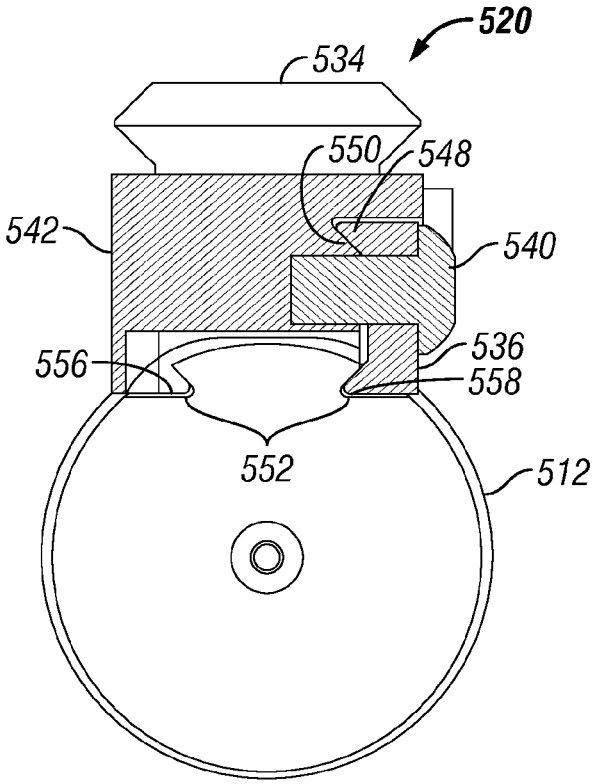
FIG. 36 is a cross-sectional view of the scope mount shown in FIGS. 31, 32, and 35 attached to the barrel.
Figure 37:
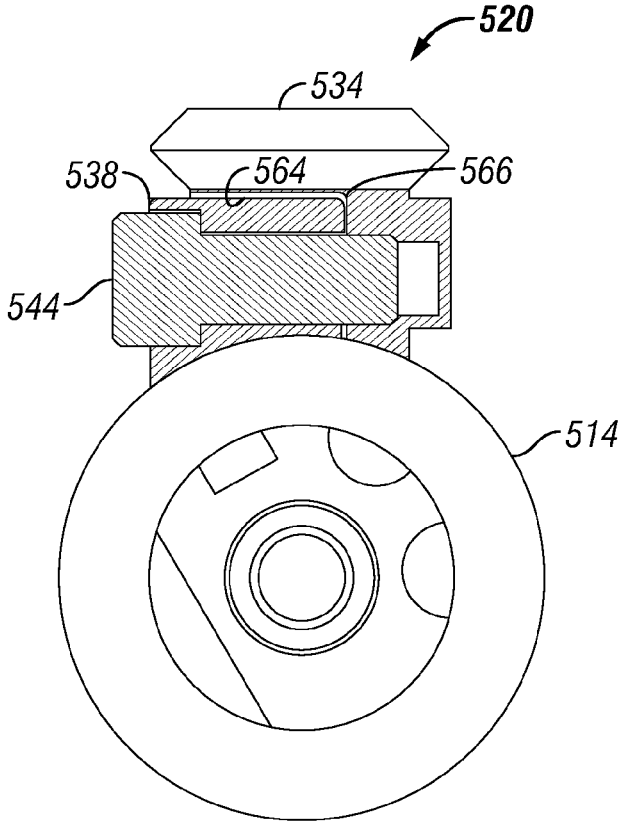
FIG. 37 is a cross-sectional view of the scope mount shown in FIGS. 31, 32, 35, and 36 attached to the receiver.
Figure 38:
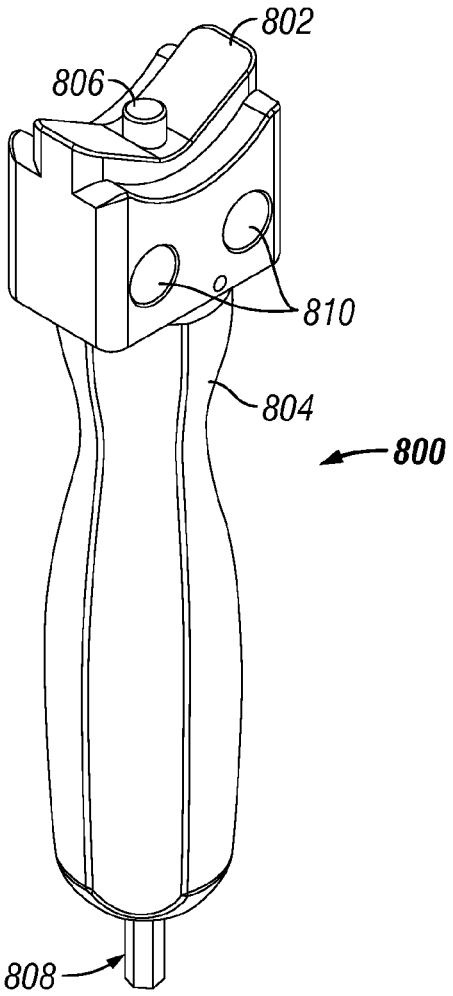
FIG. 38 is a perspective view of a V-block bolt handle tool for use in removing or attaching the barrel subgroup from or to the receiver, as shown in FIGS. 31 and 32.
Figure 39:
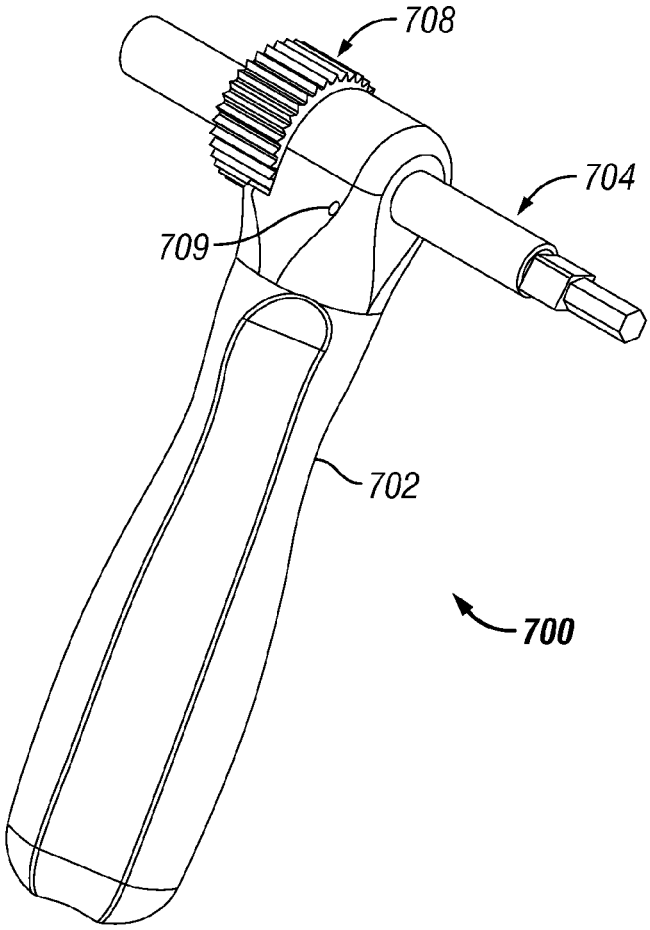
FIG. 39 is a perspective view of a barrel tool for use in removing or attaching the barrel subgroup from or to the receiver, as shown in FIGS. 31 and 32.
Figure 40:
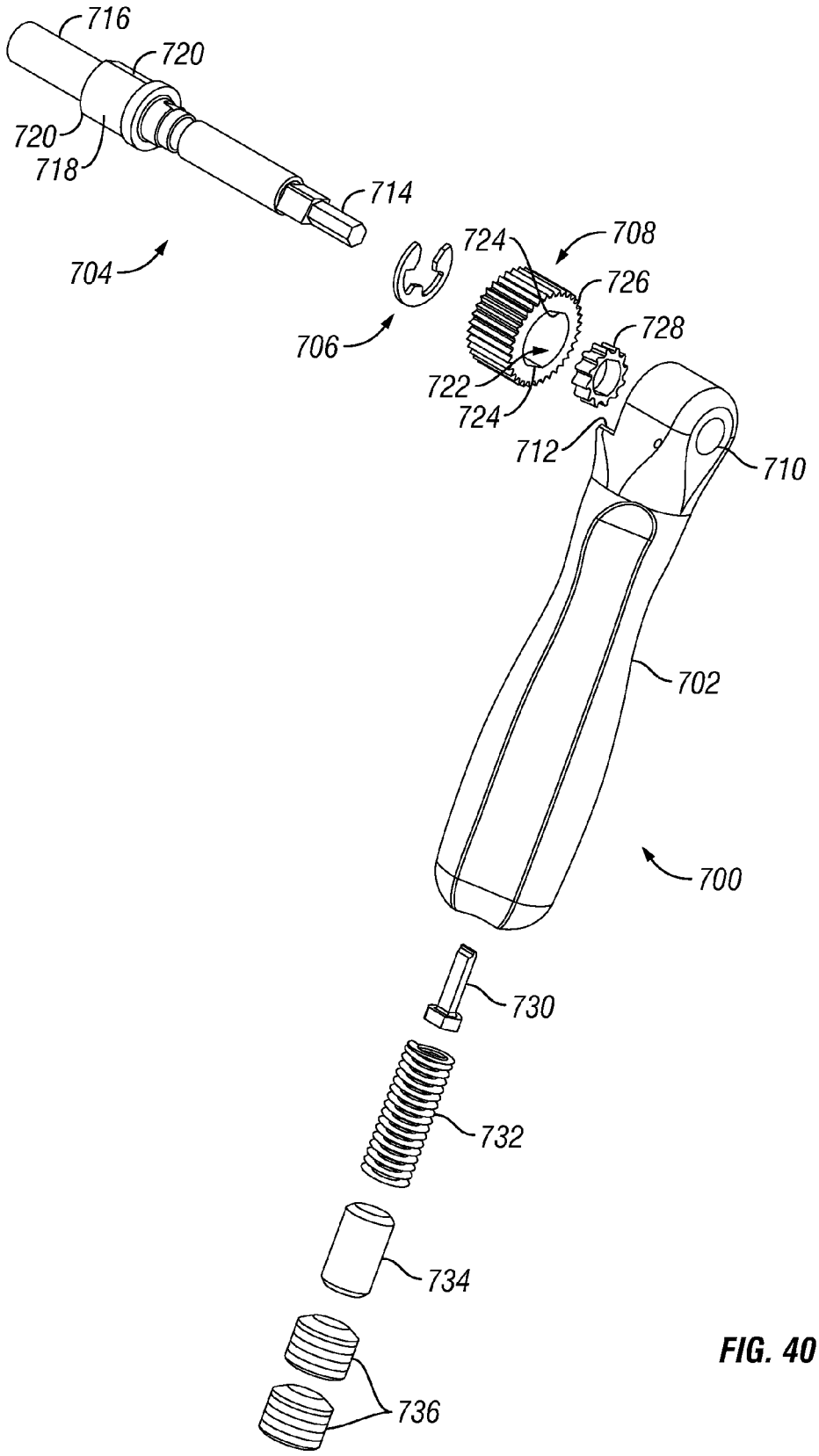
FIG. 40 is an exploded view of the barrel wrench tool of FIG. 39.
Figure 41:
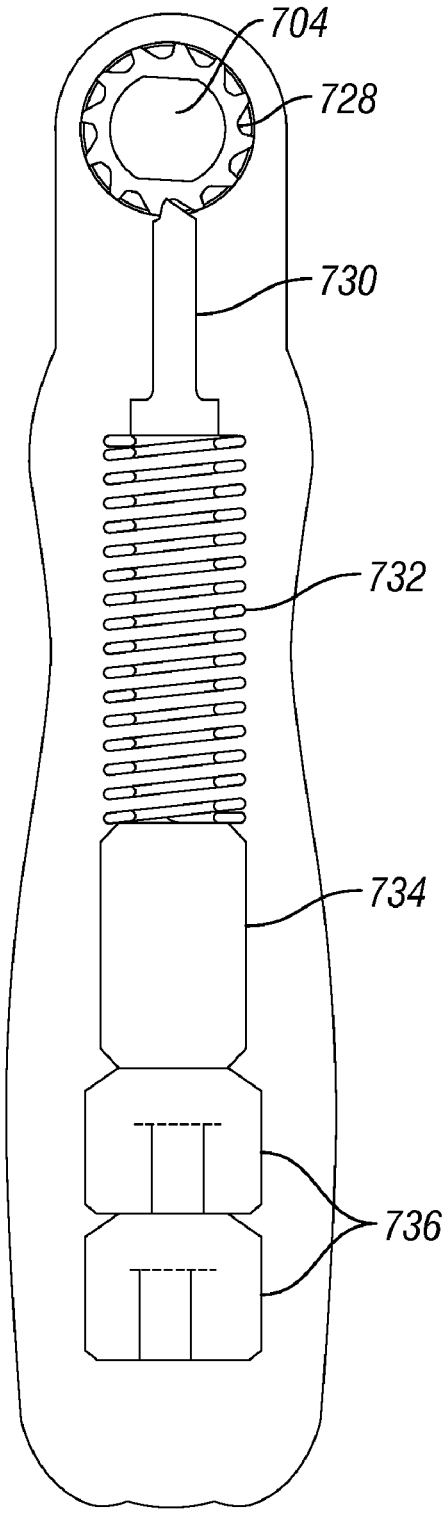
FIG. 41 is a cross-sectional view of the barrel wrench tool of FIGS. 39 and 40.

With additional reference to FIGS. 33-34, the V-blocks 108, 110 are molded into the stock 518. The stock 518 is molded to include a trigger guard 522 and defines an internal void 524 having dimensions that are similar to the guard plate 22. Thus, the rifle 510 has no need for a separate guard plate. The internal void 524 includes an action space 526 sized to accept the action 48, and a magazine well insert space 528 sized to accept a magazine well insert 530.

With continued reference to FIG. 31, the magazine well insert 530 has crush zones 532. The crush zones 532 are small, deformable tabs that extend upward from the top of the magazine well insert 530. During assembly of the rifle 510, the bolts 20 pull the receiver 514 downward toward the stock 518 to clamp the action 48 and magazine well insert 530 there between, causing the crush zones 532 to be distorted. The distortions of the crush zones 532 allow the magazine well insert 530 snuggly fit between the receiver 514 and the stock 518.

Manufacturing tolerances may cause the magazine well insert 532 to be either taller or shorter than the desired height. As a result, a magazine well insert 532 that is too tall may prevent the rifle 510 from being properly assembled, and a magazine well insert 530 that is too short may allow the assembled rifle 510 to rattle and prevent proper operation of the rifle 510. Therefore, the magazine well insert 530 has a height dimension that is slightly shorter than the nominal height of the magazine well insert space 528 that needs to be filled and the crush zones 532 extend upwards past the nominal height that is needed to be filled. As a result, the crush zones 532 are deformed during assembly and provide a snug fit of the magazine well insert 530 within the rifle, without the possibility of preventing proper assembly of the rifle 510.

Referring to FIGS. 31 and 35-37, the scope mount 520 includes a top mount 534, a front clamp 536, and a rear wedge 538. The front clamp 536 is connected to the top mount 534 by front bolts 540, which as will be discussed below, to clamp the scope mount 520 to the barrel 512. The rear wedge 538 is attached to the top of the receiver 514 by two rear bolts 542, and is then attached to the top mount 534 by a single top bolt 544.

The front bolts 540 extend through the front clamp 536 and into internally threaded holes 546 defined in the top mount 534. As a result, by tightening the front bolts 540 forces the front clamp 536 toward the top mount 534. Front clamp 536 includes a top arm 548 that extends at an angle into a longitudinal notch 550 defined in the top mount 534. The top arm 548 is angled to prevent movement of the front clamp 536 relative to top mount 534.

The barrel 512 defines two longitudinal slots 552 and a series of horizontal grooves 554 along the top of the barrel 512. Each of the top mount 534 and front clamp 536 have jaws 556, 558 that are shaped and sized to fit into the two longitudinal slots 552 to secure the front of scope mount 520 to the barrel 512. The top mount 534 includes a series of tracks 560 that are shaped and sized to correspond to the series of horizontal grooves 554. The tracks 560 and horizontal grooves 554 act to align the front of scope mount 520 with the axis of the barrel 512.

The two rear bolts 542 extend through the rear wedge 538 and into threaded holes 562 in the top of the receiver 514 to semi-permanently secure the rear wedge 538 into position. The top mount 534 is then removably attached to the rear wedge 538 by top bolt 544. The rear wedge 538 includes an aligning wedge 564 that mates with a rear notch 566 in the top mount 534. As a result, the aligning wedge 564 ensures the proper and repeated elevation of the top mount 534 in relation to the rear wedge 538.

Referring to FIGS. 38-41, a barrel wrench 700 and a V-block bolt handle 800 for attaching and removing the barrel 512 to and from the receiver 514 with the barrel nut 516 are shown. The barrel wrench 700 includes a handle 702 rotatably attached to a post 704. A lock washer 706 is used to secure a wheel 708 to the post 706. The post 706 extends through a through hole 710 defined in the handle 702 and is rotatably connected with the handle 702 by a pin 709. The wheel 708 is located within a recess 712 in the handle 702. Post 704 includes a hex key 714 at one end, a stud 716 at the other end, and a sleeve 718 there between. A pair of flats 720 are defined about the sleeve 718 that mate with an aperture 724 having a pair of platforms 726 defined within the wheel 708. The wheel 708 has wheel teeth 726 that are sized and shaped to mate with nut teeth 568 on the barrel nut 516.

The barrel wrench 700 includes a ratchet gear 728 about the post 704. The ratchet gear 728 connects with a plunger 730 to allow the post 704 to rotate in a first direction, but to prevent the post 704 from rotating in a second direction. A tool spring 732 acts against a plug 734 and a pair of stops 736 to force the plunger 730 upward and to stay in contact with the ratchet gear 728.

The V-block bolt handle 800 includes a V-head 802 for engaging with the indents 122 formed in the breech sleeves 84, and a grip 804 for manipulating the V-head 802. The grip 804 includes a rotatable threaded fastener 806 connected with an allen key 808. The V-head 802 is rotatably attached to the grip 804 and has a pair of through holes 810 that are sized to correspond to stud 716. The V-block bolt handle 800 and the V-block bolt handle 400 are substantially similar and are both attachable to the breech sleeve 84 as discussed above.

Figure 42:
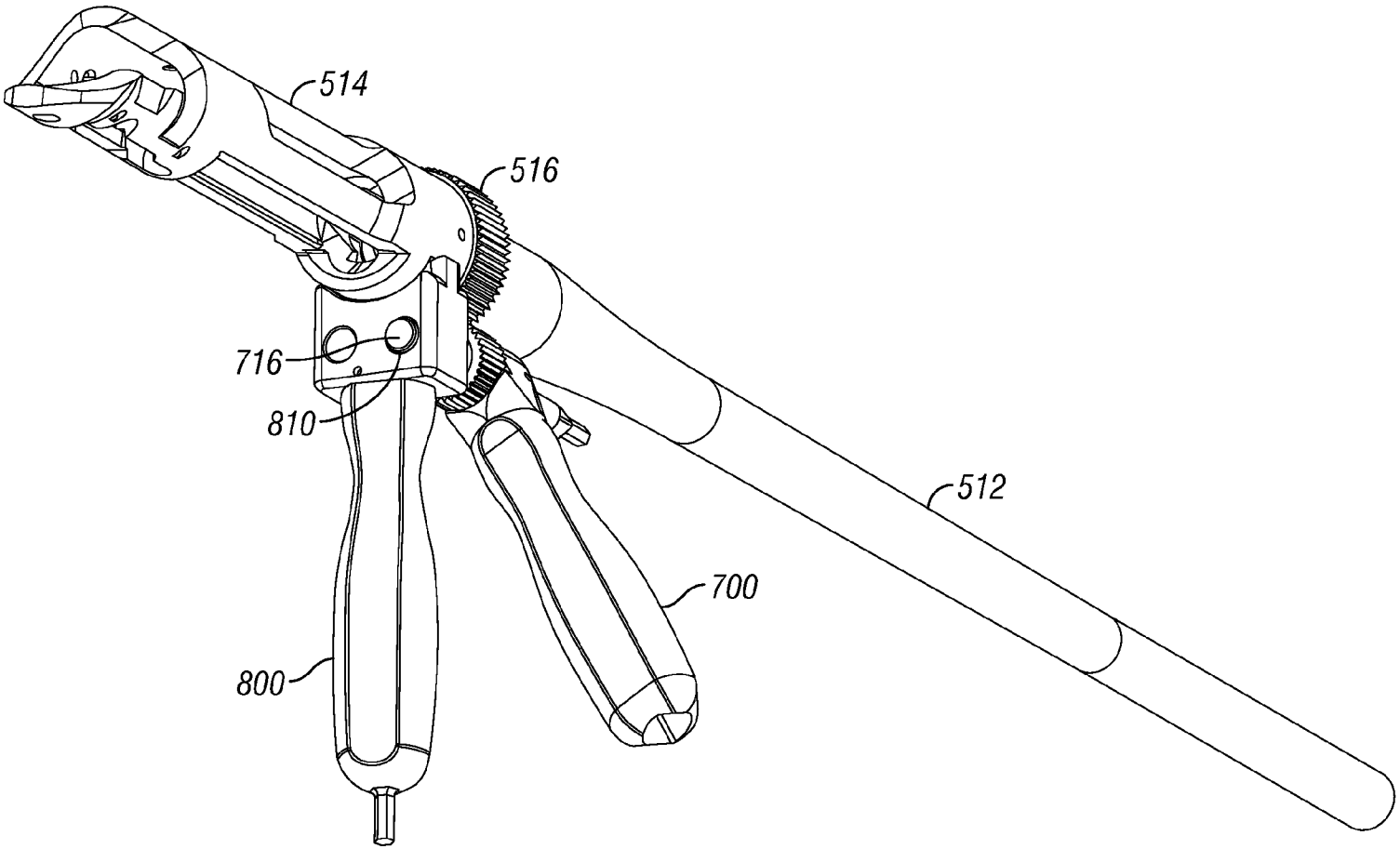
FIG. 42 is a perspective view of the use of the V-block bolt handle tool and the barrel wrench tool in assembly of the barrel subgroup to the receiver of FIGS. 30 and 31.
Figure 43:
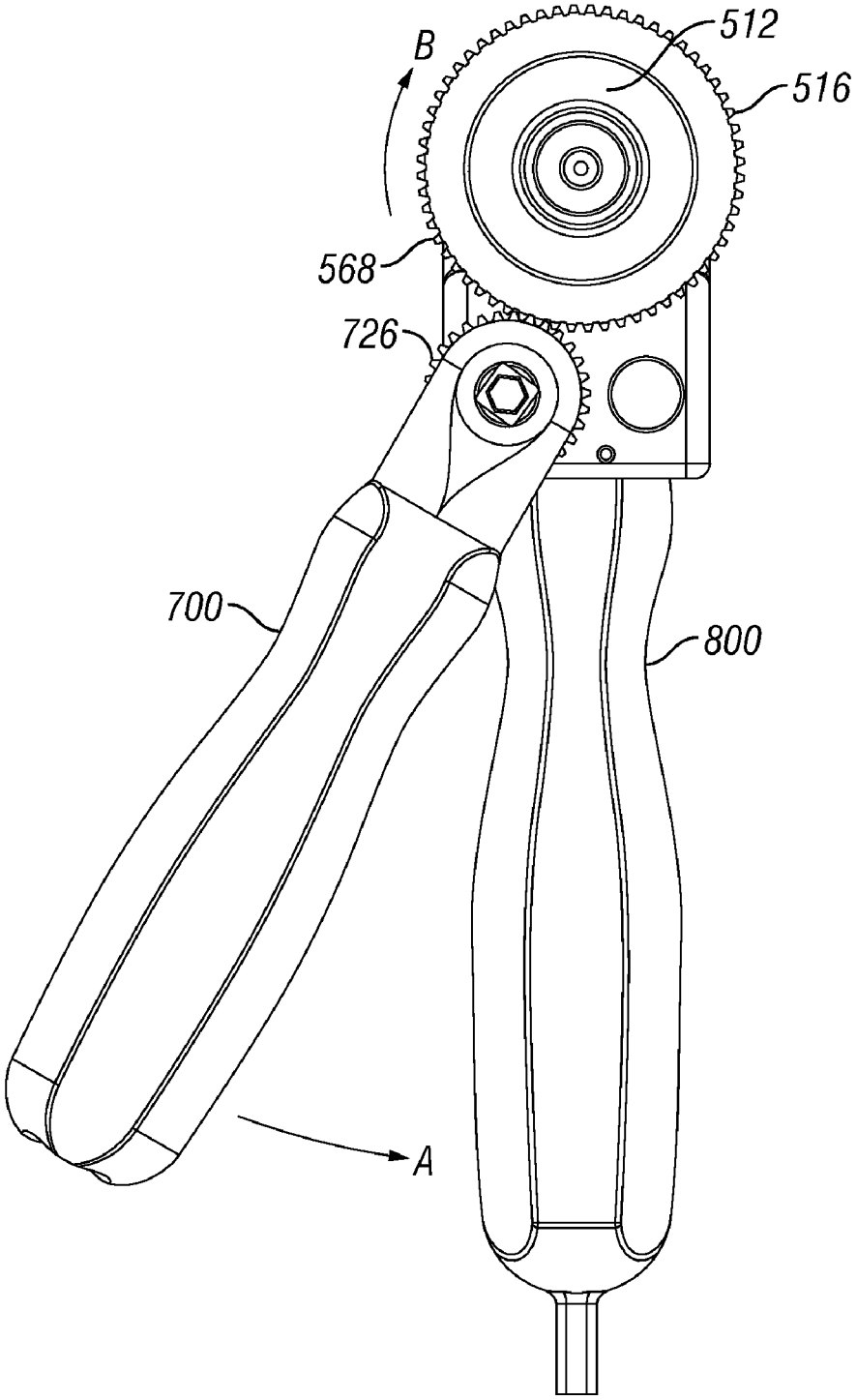
FIG. 43 is a cross-sectional view of the use of the V-block bolt handle tool and the barrel wrench tool in assembly of the barrel subgroup to the receiver of FIGS. 30, 31, and 42.
Figure 44:
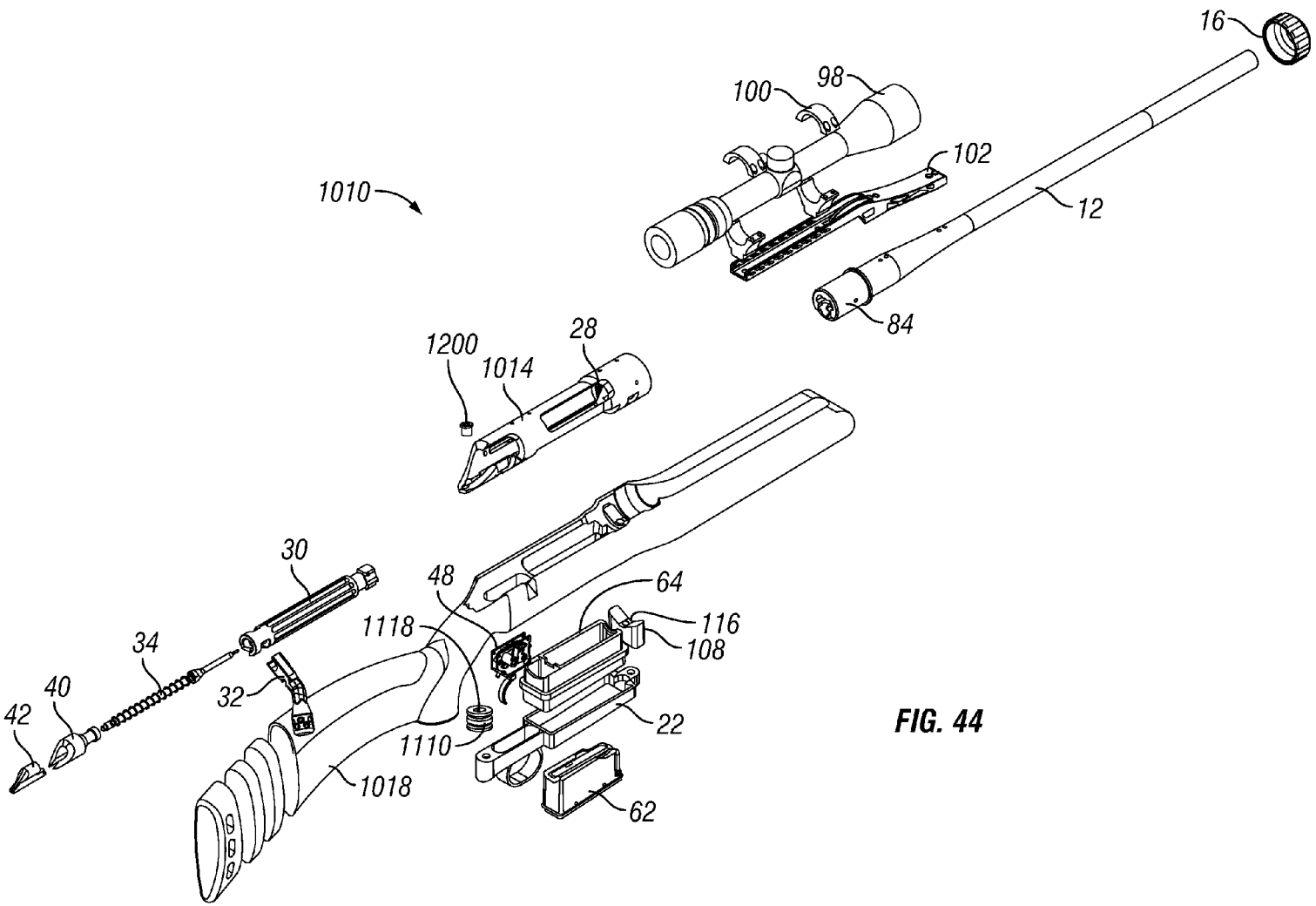
FIG. 44 is an exploded view of a multi-caliber bolt-action rifle according to another embodiment of the present invention.

As shown in FIGS. 42 and 43, the rifle 510 is assembled similarly to the method 200 discussed above, except rifle 510 does not need a guard plate and thus step 208 is eliminated. Therefore, the magazine well insert 530 is dropped into the stock 518 before the receiver 514 is assembled to the stock 518 during step 206.

During use of the barrel wrench 700 and the V-block bolt handle 800 for disassembling a barrel 512 from a receiver 514, an operator first removes the barrel 512 and the receiver 514 from the stock 518 using the reverse order of assembly steps discussed above. The operator then inserts the V-head 802 through the cutout portion 120 of receiver 14 and into the indents 122 formed in the breech sleeve 84, and turns the grip 804 to thread the fastener 806 into the tapped hole 125 provided in the breech sleeve 84 for connecting the barrel 512 to the stock 518. Once the V-block bolt handle 800 has been secured to the breech sleeve 84, the operator engages the wheel teeth 566 of the barrel wrench 700 with the nut teeth 568 of the barrel nut 516 and inserts the stud 716 into the through hole 810. The operator then prevents the rotation of the barrel 512 and the receiver 514 using the V-block bolt handle 800, and uses the barrel wrench 700 to loosen and remove the barrel nut 516 in a manner apparent to the skilled worker. Assembly is essentially the reverse of disassembly.

The method of manufacturing the rifle barrel 512 includes straightening and machining the cylindrical blank to a straight cylindrical structure having a single cylindrical outer surface about the barrel 512. The single cylindrical outer surface may have various diameters. However, the barrel 512 is void of any radial projections extending from the single cylindrical outer surface. The center of the barrel 512 is machined using conventional methods to define a given bore diameter with rifling and a chamber in the breech end of the barrel 512. The barrel 512 is machined to include at least one recess that extends inward from the single cylindrical outer surface to define a depth that is less the distance between the single cylindrical outer surface and the bore. The at least one recess may include a cavity for mounting a breech sleeve thereto or a series of angled grooves for clamping to the barrel 512.

It is well known in the art to form the barrel and a longitudinal bore through the barrel by any of the following non-inclusive list of methods that include, but are not limited to: extruding; hammer forging; drilling, reaming, and either button, broach, or cut rifle.

Another embodiment of a multi-caliber bolt action rifle 1010 in accordance with the present invention is shown in FIGS. 44-47, wherein similar components are numbered similarly to like components shown in FIGS. 1-43, except as noted. The rifle 1010 includes a barrel 12, a breech sleeve 84, a receiver 1014, and a stock 1018. The stock 1018 includes a forward V-block 108 and a rear mounting block 1110.

Receiver 1014 includes an ejection port 28, through which can be seen a bolt 30 that is slidingly housed in the receiver 1014 and is matched to the breech sleeve 84, as discussed above. The receiver 1014 for rifle 1010 is generally similar to the receiver 14 described above, except as discussed herein. With specific reference to FIG. 46, the receiver 1014 defines a flat 1020 along a bottom, aft portion of the receiver 1014. A mounting hole 1022 extends through the aft portion of the receiver 1014 and is located along the flat 1020.

Figure 47:
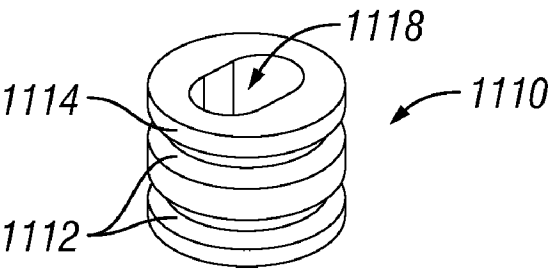
FIG. 47 is a top perspective view illustrating details of a rear mounting block of the rifle shown in FIGS. 44 and 45.

With specific reference to FIG. 47, the rear mounting block 1110, as disclosed, has a circular cross-sectional shape, a flat top, and a flat bottom. The rear mounting block 1110 has several radial recesses 1112 extending inward about an outer cylindrical wall 1114. The rear mounting block 1110 defines an elongated hole 1118 along a longitudinal axis thereof. The elongated hole 1118 extends through the flat top and the flat bottom to define a depth. The length of the elongated hole 1118 is greater than the width, and extends substantially parallel with the longitudinal axis of the stock 1018 to allow for tolerance stackup between the tapped hole 125 in the breech sleeve 84 and the mounting hole 1022 in the receiver 1014. The flat top of the rear mounting block 1110 eliminates alignment problems caused by movement associated with the cooling of a polymer stock.

Figure 45:
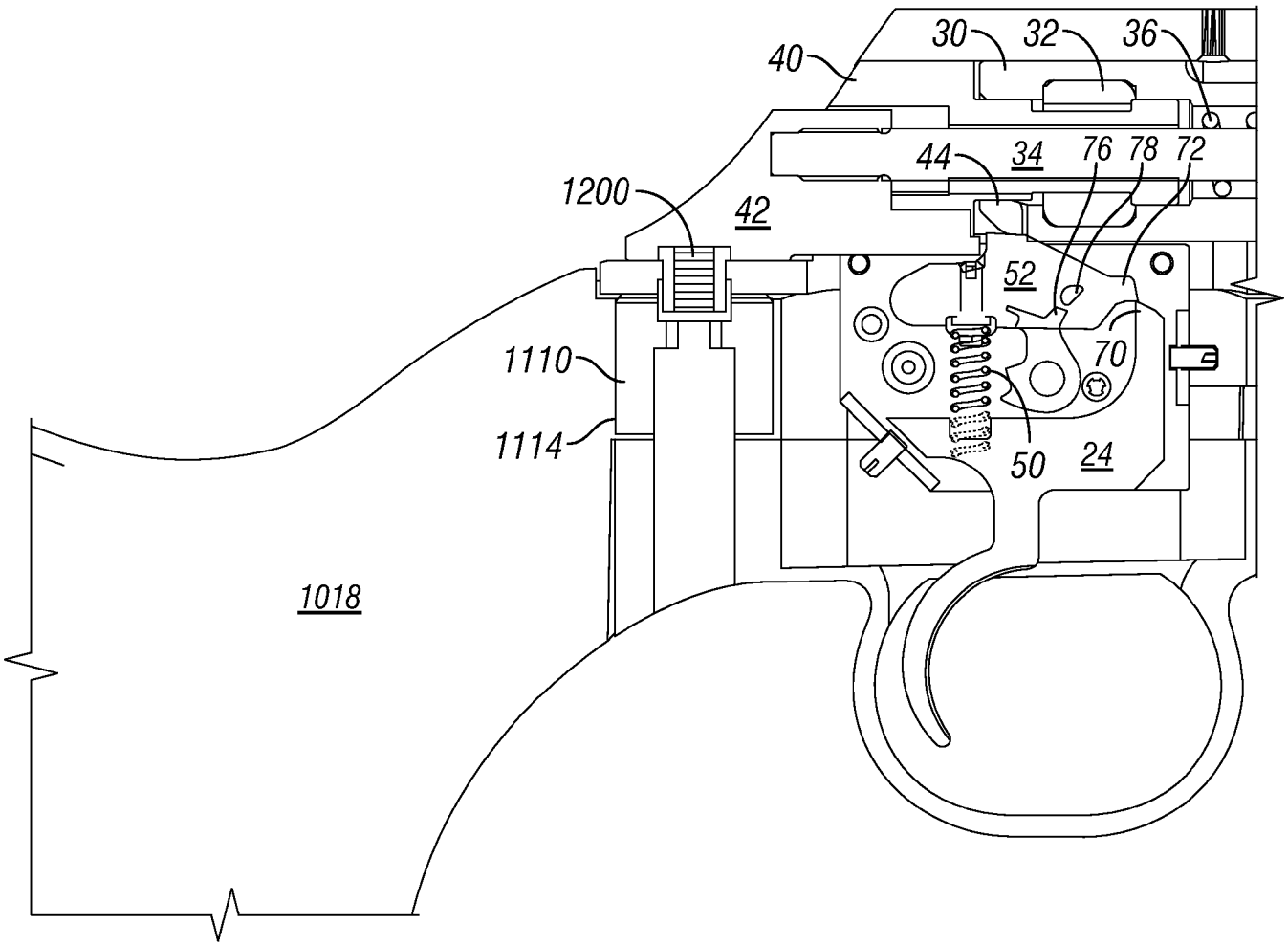
FIG. 45 is a cross-sectional view of the rifle of FIG. 44.
Figure 46:
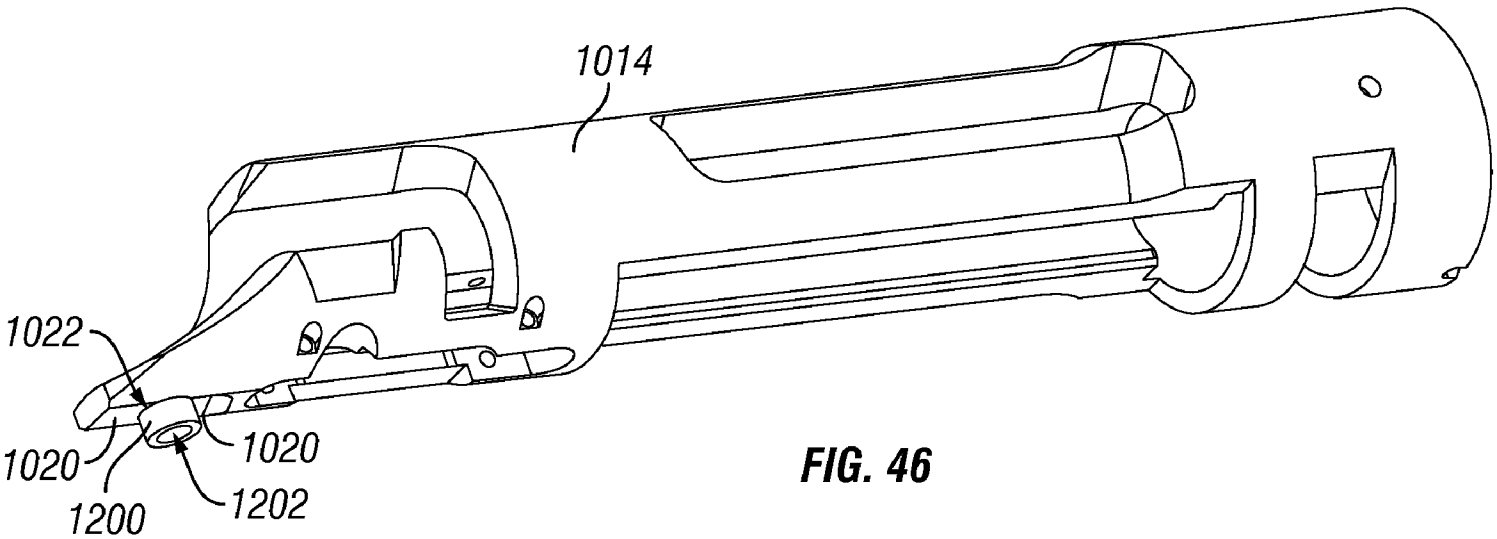
FIG. 46 is a bottom perspective view illustrating details of a receiver of the rifle shown in FIGS. 44 and 45.

With reference to FIG. 45, an insert 1200 is sized and shaped to fit into and extend through the mounting hole 1020 of the receiver 1014 and at least partially into the elongated hole 1118 of the rear mounting block 1110. The insert 1200 and the receiver 1014 may have complimentary structure to prevent the insert 1200 from rotating with respect to the receiver 1014. It is envisioned that the insert 1200 be made of steel to limit wear on the threads.

The rear mounting block 1110 is made from a substantially rigid material, such as stainless steel, aluminum, glass reinforced composite, or the like. The receiver 1014 is connected with the rear of the receiver 1014 by a second shoulder bolt 20 that extends upward through the stock 1018 and the rear mounting block 1110, and into the insert 1200 that extends downward through the receiver 1014 to capture the receiver 1014 and the rear mounting block 1110 therebetween.

The rear mounting block 1110 is sized and shaped to snugly fit within a rear pocket defined by the stock 1018. The rear pocket has an inverse cross-sectional shape that corresponds to the rear mounting block 1110. As discussed above, it is also contemplated that the rear mounting block 1110 be integrally molded into the stock 1018.

Although this invention has been shown and described with respect to the detailed embodiments thereof, it will be understood by those skilled in the art that various changes in form and detail thereof may be made without departing from the spirit and the scope of the invention.

What is claimed is:

1. A multi-caliber firearm comprising:

a first barrel;

a first breech sleeve having an inner diameter sized to accept the first barrel therein and being attached to a breech end of the first barrel, the first breech sleeve having a pair of flat surfaces extending along each side of a lower half of the first breech sleeve, the pair of surfaces forming a first angle;

a receiver defining a void being sized and shaped to at least partially accept the first breech sleeve therein, the receiver defining a cut out along a lower portion, the first breech sleeve being removably attached to the receiver to expose the pair of flat surfaces of the first breech sleeve through the cutout; and a stock having a forward V-block and a rear mounting block, the forward V-block defining a V-cut along a top portion thereof and a hole substantially aligned with the cross-sectional center of the V-block, the forward V-block extending through the cutout of the receiver to mate with the pair of flat surfaces of the first breech sleeve, the first breech sleeve being fastened with the stock through the hole in the forward V-block, the receiver being fastened to the stock through the hole in the rear mounting block.

2. The multi-caliber firearm of dam 1, further comprising a first bolt located within and extending distally from the receiver, the first bolt having a first bolt head with first lugs, the first breech sleeve having a plurality of first lands that define a plurality of first grooves being located between each of the first lands, the first lugs being sized to be inserted into corresponding first grooves.

3. The multi-caliber firearm of claim 2, wherein the first grooves and first lugs being sized and shaped to correspond with a specific caliber of cartridge such that the first grooves and first lugs may only be used in combination with the specific caliber of cartridge.

4. The multi-caliber firearm of claim 2, wherein the first barrel being located within the breech sleeve at a distance from the first lands that is substantially equivalent to the depth of the first lugs.

5. The multi-caliber firearm of claim 1, wherein the forward V-block and rear mounting block are constructed from a substantially rigid material to translate forces acting on the receiver or the first breech sleeve into the stock.

6. The multi-caliber firearm of claim 5, further comprising a second bolt and a second breech sleeve connected with a second barrel, wherein the second bolt has a second bolt head with second lugs sized and shaped to prevent insertion of the second bolt head into the first breech sleeve and to allow insertion of the second bolt head into the second breech sleeve, the second barrel defining a chamber being sized and shaped to accept a caliber cartridge that is different than that accepted within the first barrel.

7. The multi-caliber firearm of claim 5, further comprising a plurality of bolt, breech sleeve, and barrel combinations, each of the combinations being sized and shaped to accept a different caliber of cartridge.

8. The multi-caliber firearm of claim 7, wherein each of the bolt, breech sleeve, and barrel combinations are configured to be caliber dependent, such that a bolt, breech sleeve, and barrel combination for a specific caliber define the same or complementary dimensions and are incompatible with one of another caliber.

9. The multi-caliber firearm of claim 1, the first barrel defining a pair of slots along each side of the substantially cylindrical outer surface of the first barrel, each of the slots have at least one surface that forms an obtuse slot angle with an adjacent surface of an adjacent slot, the obtuse slot angle being located within the substantially cylindrical outer surface along the same side of the slots.

10. The multi-caliber firearm of claim 1, the first barrel defining a pair of slots in a single cross-sectional quadrant and extending longitudinally along each side of the substantially cylindrical outer surface of the first barrel, each of the pair of slots having an inner surface that faces in a direction other than toward the substantially cylindrical outer surface.

11. The multi-caliber firearm of claim 9, further comprising a first scope mount connected to the first barrel by a pair of jaws, each of the pair of jaws extending into each of the pair of slots and being fastened with the other of the pair of jaws to clamp the first scope mount to the first barrel.

12. The multi-caliber firearm of claim 10, further comprising a first scope mount connected by a pair of jaws to the first barrel, each of the pair of jaws extending into each of the pair of slots and fastened with the other of the pair of jaws to clamp the first scope mount to the first barrel.

13. The multi-caliber firearm of claim 1, further comprising a first scope mount haying a wedge attached to the receiver and a first top mount removably attached to the wedge, the wedge defining an aligning wedge extending therefrom, the first top mount having a rear notch being sized and shaped to accept the aligning wedge therein.

14. The multi-caliber firearm of claim 13, further comprising a second barrel, the second barrel including a second top mount, the second top mount being sized and shaped to be removable attached to the wedge attached to the receiver.

15. The multi-caliber firearm of claim 1, further comprising a first magazine well being sized and shaped to hold a first magazine well insert within the stock, the first magazine well insert being positioned between the first magazine well and the receiver and sized and shaped to accept a first magazine therein from outside of the stock.

16. The multi-caliber firearm of claim 15, wherein the first magazine well being integrally formed with the stock.

17. The multi-caliber firearm of claim 16, wherein the first magazine well insert has crush zones, the crush zones being deformable structures extending upward from a top surface of the first magazine well insert.

18. The multi-caliber firearm of claim 17, wherein the crush zones are configured to be deformed to a height defined as the distance between the top surface of the first magazine well insert and the receiver when attached to the stock.

19. A multi-caliber firearm comprising:

a barrel;

a breech sleeve having an inner diameter sized to accept the barrel therein and being attached to a breech end of the barrel, the breech sleeve having a pair of flat surfaces extending along each side of a lower half of the breech sleeve, the pair of surfaces forming a angle;

a receiver defining a void being sized and shaped to at least partially accept the breech sleeve therein, the receiver defining a cut out along a lower portion, the breech sleeve being removably attached to the receiver to expose the pair of flat surfaces of the breech sleeve through the cutout; and a stock having a forward V-block and a rear mounting block, the forward V-block defining a V-cut along a top portion thereof and a hole substantially aligned with the cross-sectional center of the V-block, the forward V-block extending through the cutout of the receiver to mate with the pair of flat surfaces of the breech sleeve, the breech sleeve being fastened with the stock through the hole in the forward V-block, the rear mounting block having an elongated hole substantially aligned with and perpendicular to a longitudinal axis of the stock to locate the receiver horizontally across the stock, the receiver being fastened to the stock through the elongated hole in the rear mounting block.

* * * * *